US011757192B2

(12) United States Patent
Lee et al.

(10) Patent No.: US 11,757,192 B2
(45) Date of Patent: Sep. 12, 2023

(54) ANTENNA DEVICE WITH PATCH INCLUDING A SLIT

(71) Applicant: DENSO CORPORATION, Kariya (JP)

(72) Inventors: Jungaun Lee, Kariya (JP); Sho Matsumoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 12 days.

(21) Appl. No.: 17/409,881

(22) Filed: Aug. 24, 2021

(65) Prior Publication Data

US 2022/0069471 A1 Mar. 3, 2022

(30) Foreign Application Priority Data

Aug. 26, 2020 (JP) ..... 2020-142758

(51) Int. Cl.
*H01Q 9/04* (2006.01)
*H01Q 1/48* (2006.01)

(52) U.S. Cl.
CPC ..... *H01Q 9/045* (2013.01); *H01Q 1/48* (2013.01)

(58) Field of Classification Search
None
See application file for complete search history.

(56) References Cited

U.S. PATENT DOCUMENTS

2016/0365644 A1* 12/2016 Finn ..... B23K 26/361
2018/0083354 A1* 3/2018 Kushta ..... H01Q 1/38
2019/0229411 A1 7/2019 Sugimoto et al.
2019/0312354 A1* 10/2019 Yanagi ..... H01Q 9/0407
2020/0076082 A1* 3/2020 Nasimuddin ..... H01Q 9/0421
2021/0021045 A1* 1/2021 Hamabe ..... H01Q 1/48
2022/0052454 A1* 2/2022 Hasegawa ..... H01Q 1/40

FOREIGN PATENT DOCUMENTS

JP 2012-90011 A 5/2012
JP 2015-177454 A 10/2015
JP 5998880 B2 9/2016

* cited by examiner

*Primary Examiner* — Wilson Lee
(74) *Attorney, Agent, or Firm* — POSZ LAW GROUP, PLC

(57) ABSTRACT

An antenna device includes a main board, a ground board, a patch, a power feeder, a short-circuit portion and an additional conductor. The main board is made of a dielectric material. The ground board is disposed at the main board and supplies a ground potential. The patch is disposed at the main board to face the ground board in a thickness direction of the main board. The power feeder is disposed at the main board and electrically connected to the patch. The short-circuit portion is a via conductor disposed at the main board, and is electrically connected to the patch and the ground board. The additional conductor is disposed at the main board such that a side surface of the additional conductor faces a side surface of the patch, and has a potential identical to the ground potential of the ground board.

9 Claims, 20 Drawing Sheets

ANTENNA DEVICE WITH PATCH INCLUDING A SLIT

CROSS REFERENCE TO RELATED APPLICATION

This application is based on Japanese Patent Application No. 2020-142758 filed on Aug. 26, 2020, the disclosure of which is incorporated herein by reference.

TECHNICAL FIELD

The present disclosure relates to an antenna device.

BACKGROUND

An antenna device may include a zeroth-order resonant antenna having a ground board and a patch.

SUMMARY

The present disclosure describes an antenna device including a main board, a ground board, a patch, a power feeder, a short-circuit portion and an additional conductor.

BRIEF DESCRIPTION OF THE DRAWINGS

The objects, features and advantages of the present disclosure will become more apparent from the following detailed description made with reference to the accompanying drawings. In the drawings.

DETAILED DESCRIPTION

Figure 1:
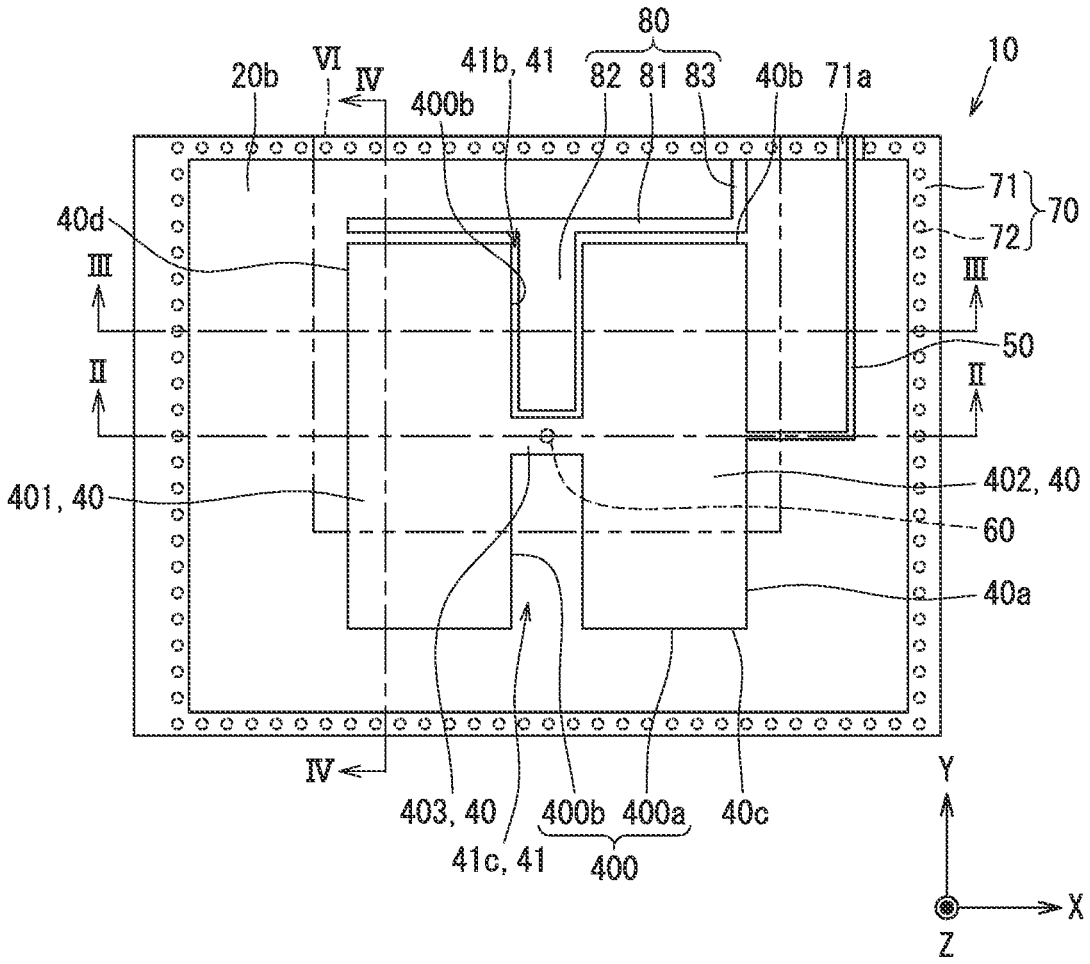
FIG. 1 is a plan view showing an antenna device according to a first embodiment.

In a zeroth-order antenna, an additional conductor may be disposed at a side opposite to a ground board with respect to a patch. In this structure, a capacitor, which is formed between the patch and the additional conductor, is connected to a capacitor formed between the patch and the ground board in parallel. Therefore, a capacitance value of the capacitor in the LC parallel resonance circuit becomes larger, and the resonance frequency is shifted to a lower frequency side as compared with a structure without having the additional conductor. In order to obtain a predetermined resonance frequency at a higher frequency side, for example, it may be required to reduce the area of the patch.

The zeroth-order resonant antenna may adopt a main board made of a dielectric material. Conductors such as a ground board, a patch, and a short-circuit portion may be disposed at the main board. The short-circuit portion may include a via conductor arranged on the main board. It may be difficult to enhance the reflection characteristics as having restrictions on, for example, the thickness of the main board and the via diameter. Therefore, there is a demand for further enhancement on the antenna device.

According to an aspect of the present disclosure, an antenna device includes a main board, a ground board, a patch, a power feeder, a short-circuit portion and an additional conductor. The main board is made of a dielectric material. The ground board is disposed at the main board and supplies a ground potential. The patch is disposed at the main board to face the ground board in a thickness direction of the main board. The power feeder is disposed at the main board and electrically connected to the patch. The short-circuit portion is a via conductor disposed at the main board, and is electrically connected to the patch and the ground board. The additional conductor is disposed at the main board such that a side surface of the additional conductor faces a side surface of the patch, and has a potential identical to the ground potential of the ground board. The patch includes an outer surface, at least one slit and an inner surface. The outer surface defines an outer contour of the patch, and the outer surface is the side surface of the patch. The slit opens to a position, which is apart from a part of the outer surface electrically connected with the power feeder. The inner surface defines the slit, and the inner surface is the side surface of the patch. The additional conductor includes a base portion, an inserting portion and a connecting portion. The base portion extends in an extending direction along the outer surface of the patch, and is disposed to face the outer surface around the aperture of the slit. The inserting portion is connected to the base portion, and is disposed inside the slit to face the inner surface of the patch. The connecting portion extends from the base portion, and electrically connects the ground board and the additional conductor.

According to the antenna device described above, a capacitor is formed at a part where the base portion of the additional conductor and the outer surface of the patch face each other. The connecting portion of the additional conductor includes an inductor. The capacitor and inductor shift the resonance frequency to a higher frequency side. Even though the area of the patch is not reduced, it is possible to shift the resonance frequency to a higher frequency side with respect to the structure without having the additional conductor.

A capacitor is formed at a portion where the inserting portion of the additional conductor faces the inner surface of the patch. This capacitor enhances the reflection characteristics. As a result, it is possible to enhance the reflection characteristics while shifting the resonance frequency to the higher resonance frequency side without changing the physical size of the patch.

Hereinafter, multiple embodiments will be described with reference to the drawings. The same reference numerals are assigned to the corresponding elements in each embodiment, and thus, duplicate descriptions may be omitted. When a part of the features in each embodiment is explained, the remaining part of the features may be provided by the features in other prior explained embodiment. Further, not only the combinations of the configurations explicitly shown in the description of the respective embodiments, but also the configurations of the plurality of embodiments can be partially combined even when they are not explicitly shown as long as there is no difficulty in the combination in particular.

First Embodiment

An antenna device according to the present embodiment transmits and/or receives radio waves of a predetermined operating frequency. The antenna device transmits and/or receives radio waves in a frequency band used in a short-range wireless communication. The operating frequency in the present embodiment is 2.44 GHz. The operating frequency may be appropriately designed and may be another frequency (for example, 5 GHz). In the following, the opposite means a state in which two objects face each other with a predetermined distance.

Structure of Antenna Device

Figure 2:
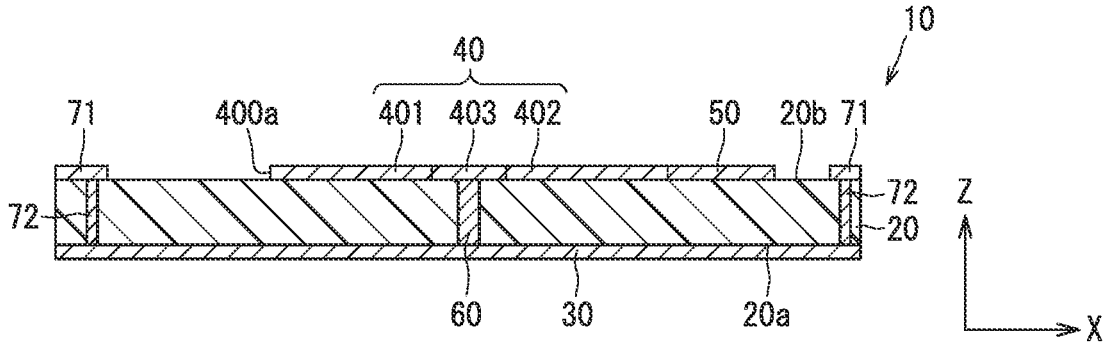
FIG. 2 is a cross-sectional view taken along line II-II of FIG. 1.
Figure 3:
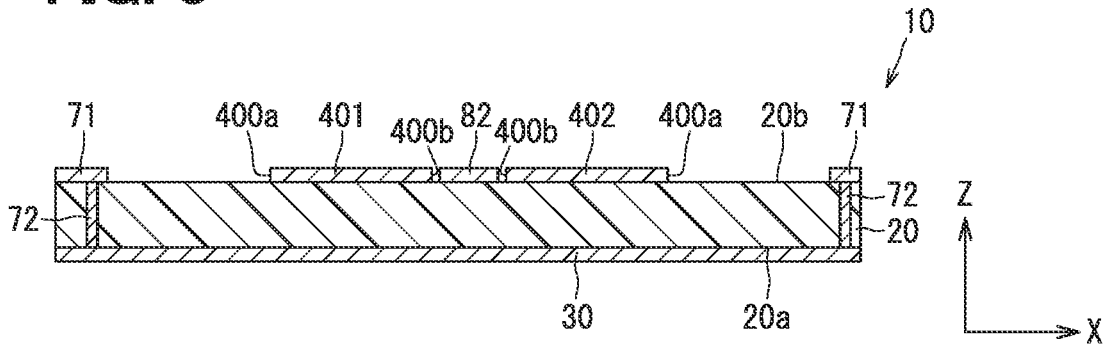
FIG. 3 is a cross-sectional view taken along line III-III of FIG. 1.
Figure 4:
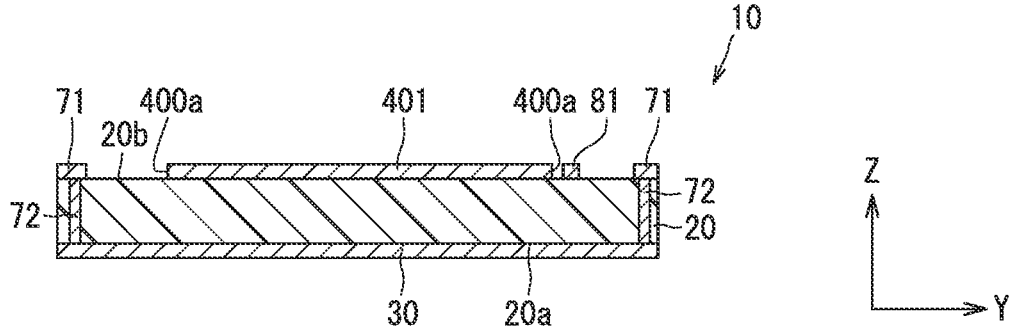
FIG. 4 is a sectional view taken along line IV-IV of FIG. 1.

First, the following describes the structure of the antenna device with reference to FIGS. 1 to 4. FIG. 1 is a plan view of the antenna device according to the present embodiment in a board thickness direction of a board viewed from a patch. FIG. 2 is a cross-sectional view taken along line III-III of FIG. 1. FIG. 3 is a cross-sectional view taken along line III-III of FIG. 1. FIG. 4 is a cross-sectional view taken along line IV-IV of FIG. 1.

As illustrated in FIGS. 1 to 4, an antenna device 10 includes a main board 20, a ground board 30, a patch 40, a power feeder 50, a short-circuit portion 60. The antenna device 10 is configured on a printed circuit board. In other words, the antenna is mounted on the printed circuit board. The main board 20 is, for example, an insulating base material of a printed circuit board. The main board 20 may also be referred to as a substrate or a main plate. The elements other than the main board 20, that is, the ground board 30, the patch 40, the power feeder 50, and the short-circuit portion 60 are conductor elements of the printed circuit board. The ground board 30 may also be referred to as a ground plate or bottom plate. The patch 40 may also be referred to as a patch portion. The power feeder 50 may also be referred to as an electric feeding line, a power feeding line, or a power supply line.

In the following, a board thickness direction of the main board 20 is defined as a Z direction, and one direction orthogonal to the Z direction is defined as a X direction. The direction orthogonal to the Z direction and the X direction is defined as the Y direction. Unless otherwise specified, a shape viewed in a plane from the Z direction, that is, a shape along an XY plane defined by the X and Y directions is referred to as a planar shape.

The main board 20 is made of a dielectric material such as resin. By using the main board 20, a wavelength shortening effect by the dielectric material can be expected. As the main board 20, for example, a member made of only resin, or a combination of resin and glass cloth, non-woven fabric, or the like can be adopted. The main board 20 functions as a holding portion that holds the ground board 30 and the patch 40 in a predetermined positional relationship.

The main board 20 includes a main surface 20*a* and a rear surface 20*b* as a surface opposite to the main surface 20*a* in the Z direction. In the present embodiment, the ground board 30 is disposed at the main surface 20*a* of the main board 20, and the patch 40 and the power feeder 50 are disposed at the rear surface 20*b* of the main board 20. Depending on the thickness of the main board 20, an opposite distance between the ground board 30 and the patch 40 and a length of the short-circuit portion 60 in the Z direction can be adjusted. The main board 20 may have a single-layer structure or a multi-layer structure.

The ground board 30 is connected to a feeder circuit (not shown) to supply a ground potential of the antenna device 10. The ground board 30 provides a ground potential by electrically connecting, for example, an external conductor of a coaxial cable. The ground board 30 is a flat plate-shaped conductor made of copper or the like. The direction perpendicular to a board surface of the ground board 30 is also substantially parallel to the Z direction. In a plan view, the area of the ground board 30 is larger than the area of the patch 40. The ground board 30 has a size that includes the entire patch 40. The ground board 30 may have a size required for stable operation of the antenna device, in other words, zeroth-order resonant antenna.

The ground board 30 of the present embodiment has a substantially rectangular planar shape. Each side of the ground board 30 has a length of, for example, one or more times the wavelength of the radio wave of the operating frequency, that is, one wavelength or more. The ground board 30 is disposed at the main surface 20*a* of the main board 20 as described above. The ground board 30 is formed by patterning a metal foil arranged at the main surface 20*a* of the main board 20. The planar shape of the ground board 30 can be changed as appropriate. In the present embodiment, the planar shape of the ground board 30 is a rectangle as an example, but as another configuration, the planar shape of the ground board 30 may be square or other polygonal shapes. Further, the planar shape of the ground board 30 may be circular (including an ellipse). The ground board 30 may be formed to have a size larger than a circle having a diameter of one wavelength.

The patch 40 is a conductor made of copper or the like. The patch 40 is a conductor arranged to face the ground board 30 so as to have a predetermined distance from the patch 40 in the Z direction. The patch 40 may also be referred to as a radiating element. In a plan view, the entire patch 40 overlaps the ground board 30. That is, the entire board surface (lower surface) of the patch 40 faces the ground board 30 in the Z direction. The patch 40 is arranged substantially parallel to the ground board 30. Substantially parallel is not limited to perfect parallelism. For example, the patch 40 may be tilted by several degrees to ten degrees with respect to the ground board 30.

The patch 40 according to the present embodiment is disposed at the rear surface 20*b* of the main board 20 as described above. The patch 40 is formed by patterning a metal foil arranged at the rear surface 20*b* of the main board 20. The basic shape of the patch 40 is a substantially square. The patch 40 has a substantially H-shape by providing two slits 41 described later in a substantially square shape. The basic shape is the outer contour of the patch 40 in a plan view. The patch 40 has four sides that define the outer contour in a plan view. The patch 40 includes power feeding side 40*a*, adjacent sides 40*b*, 40*c*, and an opposite side 40*d*. The power feeding side 40*a* is electrically connected with the power feeder 50. The adjacent sides 40*b*, 40*c* connect the power feeding side 40*a*. The opposite side 40*d* is at a position opposite to the power feeding side 40*a*. The power feeding side 40*a* and the opposite side 40*d* are substantially parallel in the X direction. The adjacent sides 40*b*, 40*c* are substantially parallel in the X direction.

The patch 40 and the ground board 30 are disposed to face to each other to form an electrostatic capacitor according to an area of the patch 40 and the distance between the patch 40 and the ground board 30. The patch 40 is formed to have a size that forms a capacitance or a capacitor that resonates in parallel with the inductance of the short-circuit portion 60 at a target frequency. The area of the patch 40 is appropriately designed to provide the desired capacitance and thus to operate at the operating frequency.

In the present embodiment, the basic shape, in other words, the outer contour of the patch 40 is square as an example, but as another configuration, the planar shape of the patch 40 may be circular, regular octagon, regular hexagon, or the like. The basic shape of the patch 40 may have a line-symmetrical shape, that is, a bidirectional line-symmetric shape, with each of two straight lines orthogonal to each other as axes of symmetry. The bidirectional line symmetrical shape refers to a figure that is line-symmetric with a first straight line as an axis of symmetry, and that is also line-symmetric with respect to a second straight line that is orthogonal to the first straight line. The bidirectional line symmetrical shape corresponds to, for example, an ellipse, a rectangle, a circle, a square, a regular hexagon, a regular octagon, a rhombus, or the like. Further, the patch 40 may also be a point-symmetrical figure such as a circle, a square, a rectangle, or a parallelogram.

The power feeder 50 is a conductor for supplying electricity to the patch 40. The power feeder 50 extends in a direction perpendicular to the Z direction from an edge portion of the patch 40. The power feeder 50 includes a portion extending from the power supply point along a virtual straight line connecting a substantially center of the patch 40 and the power supply point. One of the end portions of the power feeder 50 is electrically connected to the end portion of the patch 40. The other end portion of the power feeder 50 is electrically connected to the inner conductor of the coaxial cable. The connecting portion between the power feeder 50 and patch 40 corresponds to the power supply point. The current flowing into the power feeder 50 through the coaxial cable is conducted to the patch 40 and resonates the patch 40. The power supply method is not limited to the direct power supply method. A power supply method in which the power feeder 50 and the patch 40 are electromagnetically coupled may also be adopted.

The power feeder 50 according to the present embodiment is a conductor disposed at the rear surface 20*b* of the main board 20 as described above. This conductor is sometimes referred to as a microstrip line. The power feeder 50 is formed by patterning a metal foil arranged at the rear surface 20*b* of the main board 20. The power feeder 50 is formed integrally with the patch 40. The power feeder 50 extends in the X direction from the power feeding side 40*a* of the patch 40. The power feeder 50 is connected to a substantially central portion of the power feeding side 40*a* in the Y direction. The power feeder 50 has a substantially L-shaped in a plan view. The power feeder 50 extends in the X direction from the edge portion of the patch 40, and extends in the Y direction from the end portion of the extending portion in the X direction. The power feeder 50 is arranged to face the ground board 30 in the Z direction.

The short-circuit portion 60 electrically connects, that is, short-circuits the ground board 30 and the patch 40. The short-circuit portion 60 is a columnar conductor arranged at the main board 20. One of the end portions of the short-circuit portion 60 is connected to the ground board 30, and the other one of the end portions of the short-circuit portion 60 is connected to the patch 40. The short-circuit portion 60 has, for example, a substantially circular plane. By adjusting the diameter and length of the short-circuit portion 60, the inductance provided in the short-circuit portion 60 can be adjusted. The short-circuit portion 60 is connected to substantially the center of the patch 40 in a plan view. Further, the center of the patch 40 corresponds to the centroid of the patch 40.

Since the patch 40 according to the present embodiment has a square planar shape, the center corresponds to an intersection of two diagonal lines of the patch 40. The short-circuit portion 60 is a via conductor in which a conductor is arranged in a through hole formed at the main board 20. The through hole may also be referred to as a via. The through hole penetrates the main board 20 from the main surface 20*a* to the rear surface 20*b*. The number of via conductors constituting the short-circuit portion 60 is not particularly limited. In the present embodiment, one via conductor includes the short-circuit portion 60. The short-circuit portion 60 may be formed by multiple via conductors arranged in parallel between the ground board 30 and the patch 40.

The antenna device 10 further includes a shield portion 70. The shield portion 70 has the same potential as the ground board 30 and functions as an electromagnetic wave shield. The shield portion 70 according to the present embodiment has a ground conductor 71 and a via conductor 72. The ground conductor 71 is arranged on the rear surface 20*b* of the main board 20. The ground conductor 71 surrounds the patch 40 in a plan view. The ground conductor 71 is formed by patterning a metal foil arranged at the rear surface 20*b* of the main board 20. The ground conductor 71 includes a notch 71*a*. The power feeder 50 is led out to the outside of the ground conductor 71 through the notch 71*a*. The ground conductor 71 has a substantially C-shaped in a plan view. The ground conductor 71 faces each of the four sides of the patch 40.

The via conductor 72 is a conductor arranged in a through hole formed at the main board 20. The through hole may also be referred to as a via. The through hole penetrates the main board 20 in the Z direction. The via conductor 72 extends in the Z direction. One of the end portions of the via conductor 72 is connected to the ground board 30, and the other one of the end portions of the via conductor 72 is connected to the ground conductor 71. The shield portion 70 includes multiple via conductors 72. The via conductors 72 are arranged side by side along the extending direction of the ground conductor 71. The via conductors 72 are arranged at intervals of a half wavelength or less of the operating frequency so that electromagnetic waves do not leak from the adjacent via conductors 72.

The ground conductor 71 is connected to the ground board 30 through the via conductor 72. Therefore, the outer conductor of the coaxial cable may be connected to the ground conductor 71 so that the ground board 30 provides the ground potential. The configuration of the shield portion 70 may not be limited to the above example. For example, a configuration in which the ground conductor 71 is excluded, that is, a configuration in which only the via conductor 72 is provided may be used. The arrangement of the shield portion 70 in a plan view may not be limited to the above example. The shield portion 70 may be arranged so as to face only a part of the side of the patch 40. For example, it may be arranged so as to face only one of the four sides of the patch 40.

The connection between the antenna device 10 and the power supply circuit (wireless device) is not limited to the coaxial cable. The antenna device 10 and the power supply circuit may be connected by using another communication cable such as a power supply line or a feeding line. Further, the antenna device 10 and the power supply circuit may be connected via a matching circuit, a filter circuit, or the like in addition to the coaxial cable. The antenna device 10 may be provided integrally with the power supply circuit.

Antenna Operation

The following describes the operation of the antenna device 10. The antenna device 10 configured in this way has a structure in which the ground board 30 and the patch 40 facing each other are connected by the short-circuit portion 60. This structure is a so-called mushroom structure, which is the same as a basic structure of metamaterials. Since the antenna device 10 is an antenna to which a metamaterial technology is applied, the antenna device 10 is sometimes called a metamaterial antenna.

Since the antenna device 10 is designed to operate in the zeroth-order resonant mode at a desired operating frequency, the antenna device may also be referred to as a zeroth-order resonant antenna. Among the dispersion characteristics of metamaterials, a phenomenon of resonance at a frequency at which a phase constant $\beta$ becomes zero (0) is the zeroth-order resonance. The phase constant $\beta$ is an imaginary part of a propagation coefficient $\gamma$ of a wave propagating on a transmission line. The antenna device 10 can satisfactorily transmit and/or receive radio waves in a predetermined band including the frequency at which the zeroth-order resonance occurs.

The antenna device 10 operates by LC parallel resonance of a capacitor formed between the ground board 30 and the patch 40 and an inductor provided in the short-circuit portion 60. In the equivalent circuit described hereinafter, the capacitor formed between the ground board 30 and the patch 40 is referred to as C1, and the inductor formed in the short-circuit portion 60 is referred to as L1. In the antenna device 10, the patch 40 is short-circuited to the ground board 30 by the short-circuit portion 60 provided in the central region of the patch 40. The area of the patch 40 is an area that forms a capacitor that resonates in parallel with the inductor of the short-circuit portion 60 at a desired frequency (operating frequency). The value of the inductor is determined according to the dimension of each part of the short-circuit portion 60, for example, the diameter and the length of the short-circuit portion 60 in the Z direction. The value of the inductor may also be referred to as inductance.

Therefore, when electric power of the operating frequency is supplied, parallel resonance occurs due to energy exchange between the inductor and the capacitor, and an electric field perpendicular to the ground board 30 and the patch 40 is generated between the ground board 30 and the patch 40. That is, an electric field in the Z direction is generated. This vertical electric field propagates from the short-circuit portion 60 toward the edge portion of the patch 40 becomes vertically polarized at the edge portion of the patch 40, and propagates in space. The vertically polarized wave here refers to a radio wave in which the vibration direction of the electric field is perpendicular to the ground board 30 and the patch 40. Further, the antenna device 10 receives a vertically polarized wave coming from the outside of the antenna device 10 by LC parallel resonance.

The resonance frequency of the zeroth-order resonance does not depend on the antenna size. Therefore, the length of one side of the patch 40 can be made shorter than ½ wavelength of the zeroth-order resonance frequency. For example, even if one side has a length equivalent to a one-quarter wavelength, zeroth-order resonance can be generated. For example, when the operating frequency is 2.44 GHz, the wavelength $\lambda\varepsilon$ can be obtained by (300 [mm/s]/2.44 [GHz])/square root of the dielectric constant of the main board 20 in the configuration including the main board 20. It is possible to make one side shorter than a one-quarter wavelength. However, for instance, the gain such as antenna gain is reduced.

Slits and Additional Conductors

Figure 5:
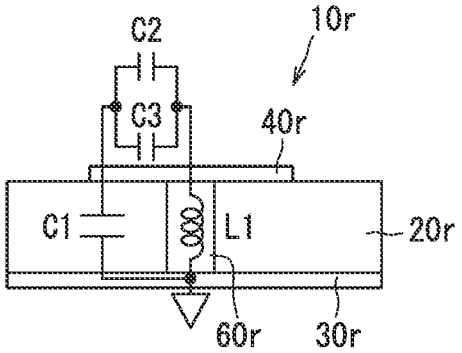
FIG. 5 is an equivalent circuit diagram of a reference example.
Figure 6:
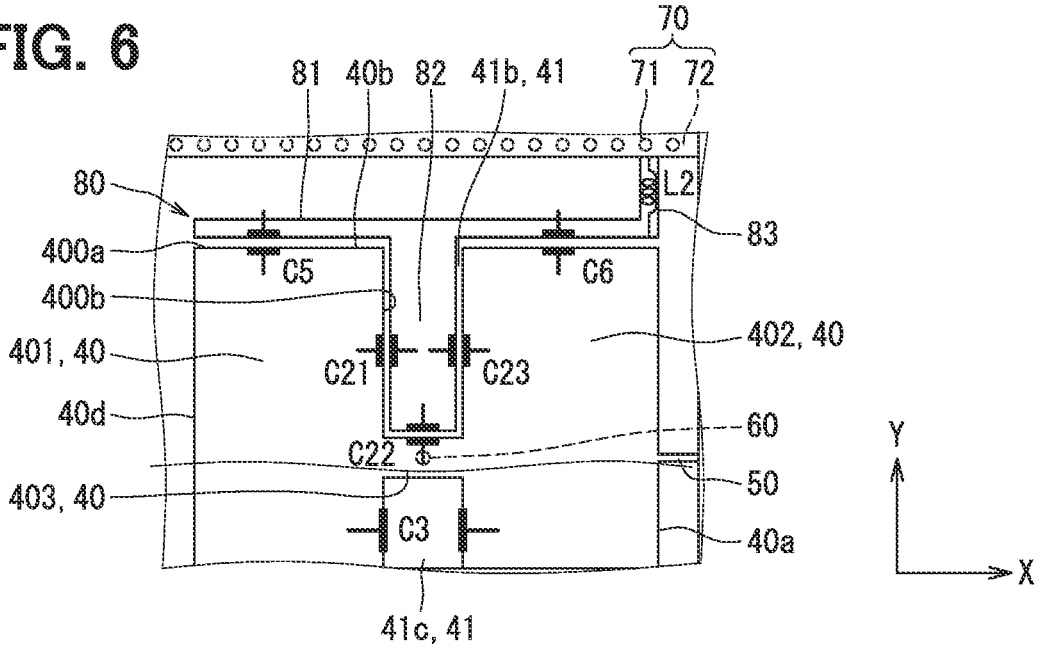
FIG. 6 is a diagram in which region VI of FIG. 1 is enlarged.

The following describes additional structures according to the present embodiment added to the basic structure of the zeroth-order resonant antenna with reference to FIGS. 1 to 7. FIG. 5 illustrates an equivalent circuit diagram of a reference example of the antenna device. In the reference example, the elements identical or related to the present embodiment are denoted by adding "r" to the tails of the reference numerals in the present embodiment. However, common reference numerals are given to the capacitors and inductors. In FIG. 5, for convenience, some circuit elements, for example, an inductor included in the patch, are omitted. FIG. 6 is a diagram in which region VI of FIG. 1 is enlarged; FIG. 6 also shows a variety of capacitors and inductors.

As FIGS. 1 and 3, in the antenna device 10 according to the present embodiment, the patch 40 has at least one slit 41. The slit 41 has a predetermined depth in the Z direction and has an aperture opening to a side surface 400 of the patch 40. The aperture may also be referred to as an opening. In particular, the side surface 400 has an aperture opening to an outer surface 400*a*. The side surface 400 is a surface that connects the lower surface of the patch 40 at the main board 20 and the upper surface of the main board 20 opposite to the lower surface in the Z direction. The side surface 400 is substantially parallel to the Z direction. The outer surface 400*a* defines or specifies the outer contour of the patch 40. The outer surface 400*a* is a surface derived from the outer peripheral surface of the basic shape of the patch 40. The side surface 400 has an inner surface 400*b* that defines or specifies a slit 41. The inner surface 400*b* is different from the outer surface 400*a*. The inner surface 400*b* is connected to the outer surface 400*a*. The inner surface 400*b* may also be referred to as an inner side surface. The outer surface 400*a* may also be referred to an outer side surface.

The aperture of the slit 41 is formed apart from the power feeding point at the outer surface 400*a* of the patch 40. For example, in the planar square patch 40, the slit 41 has an aperture at a side different from the power feeding side 40*a*. The shape, size, arrangement, and number of slits 41 are not limited to the above examples. The patch 40 may have only one slit 41 or may have multiple slits 41. The positions of the two slits 41 may be staggered in a single direction orthogonal to the Z direction. The slit 41 may be provided so as to have an aperture opening to the outer surface 400*a* at the opposite side 40*d*. The slit 41 is not limited to a straight line. For example, the slit 41 having a substantially L-shaped in a plan view may be adopted.

The slit 41 may be a groove provided halfway in the depth of the patch 40. The slit 41 according to the present embodiment penetrates the patch 40 in the Z direction. The patch 40 has two slits 41. The two slits 41 are provided so that the patch 40 has two-fold symmetry around the Z axis. When the slits 41 are provided to have two-fold symmetry, the bias of the electric field distribution can be suppressed.

The two slits 41 are provided so as to sandwich the short-circuit portion 60, in other words, the substantially center of the patch 40 in the Y direction in a plan view. One of the slits 41 has an aperture opening to the outer surface 400*a* at the adjacent side 40*b*, and extends in the Y direction toward the center of the patch 40. The other one of the slits 41 has an aperture opening to the outer surface 400*a* at the adjacent side 40*c*, and extends in the Y direction toward the center of the patch 40. Each of the slits 41 has the substantially rectangular plane shape of which longitudinal direction is the Y direction. In the following, the slit 41 having an aperture opening to the adjacent side 40*b* may be referred to as a slit 41*b*, and the slit 41 having an aperture opening to the adjacent side 41*c* may be referred to as a slit 41*c*.

The extending length and width of the two slits 41*b*, 41*c* are equal to each other. The slits 41*b*, 41*c* divide the patch 40 into the first patch portion 401, the second patch portion 402 and the third patch portion 403. The first patch portion 401 and the second patch portion 402 have the same shape and area. The first patch portion 401 is a portion at the opposite side 40*d* with respect to the slits 41*b*, 41*c*. The second patch portion 402 is a portion at the power feeding side 40*a* with respect to the slits 41*b*, 41*c*. The third patch portion 403 is a portion sandwiched between the two slits 41*b* and 41*c*, and connects the first patch portion 401 and the second patch portion 402. The extending length of each of the slits 41*b* and 41*c* is longer than the length of the third patch portion 403 in the Y direction. The respective widths of the slits 41*b*, 41*c* are shorter than the respective lengths of the first patch portion 401 and the second patch portion 402 in the X direction. The patch 40 includes the slits 41*b*, 41*c*, the first patch portion 401, the second patch portion 402, and the third patch portion 403 so as to form a substantially planar H-shape.

An antenna device 10*r* in the reference example of FIG. 5 has a structure in which an additional conductor 80 described hereinafter is excluded from the antenna device 10 in the present embodiment. A patch 40*r* has two slits (not shown) similar to the slits 41*b*, 41*c* as described above. A capacitor C2 is formed between the first patch portion and the second patch portion by one of the slits. A capacitor C3 is formed between the first patch portion and the second patch portion by the one of the slits. These capacitors C2 and C3 are connected in parallel to each other. The parallel circuit of the capacitors C2, C3 is connected between the capacitor C1 and the inductor L1. If a slit is provided in the patch 40*r* and the capacitor is connected between the capacitor C1 and the inductor L1, the reflection characteristics can be improved.

As illustrated in FIGS. 1, 3, 4 and 6, the antenna device 10 further includes the additional conductor 80. The additional conductor 80 is a conductor added to the basic configuration of the zeroth-order resonant antenna. The additional conductor 80 is a conductor made of copper or the like and having the potential (ground potential) identical to the ground board 30. The additional conductor 80 is arranged at the main board 20 so that the side surface of the additional conductor 80 faces the side surface of the patch 40 with a predetermined distance. In a plan view, the entire additional conductor 80 overlaps the ground board 30.

The additional conductor 80 is arranged on the rear surface 20*b* of the main board 20. That is, the additional conductor 80 is arranged on the identical surface shared by the patch 40 and the power feeder 50. The additional conductor 80 is formed by patterning a metal foil arranged at the rear surface 20*b* of the main board 20. The thickness of the additional conductor 80 is substantially equal to that of the patch 40 and the power feeder 50. The additional conductor 80 has a base portion 81, an inserting portion 82, and a connecting portion 83.

The base portion 81 extends along the outer surface 400*a* of the patch 40. The base portion 81 is arranged so as to face the outer surface 400*a* around the aperture of the slit 41. The base portion 81 may be arranged to straddle the aperture of the slit 41, or may be arranged only on one side with respect to the slit 41.

In the present embodiment, the base portion 81 is arranged to face the outer surface 400*a* of the adjacent side 40*b*. The base portion 81 faces the outer surface 400*a* around the aperture of the slit 41*b*. The base portion 81 faces each of the first patch portion 401 and the second patch portion 402. The base portion 81 extends in the X-direction. With the above-mentioned arrangement, the capacitor C5 is formed between the portion of the first patch portion 401 and the side surface of the base portion 81 at the outer surface 400*a* of the adjacent side 40*b*. The capacitor C6 is formed between the portion of the second patch portion 402 and the side surface of the base portion 81 at the outer surface 400*a* of the adjacent side 40*b*.

The capacitance values, in other words, the electrostatic capacitance of the capacitors C5, C6 are determined by the distance between the base portion 81 and the outer surface 400*a* of the patch 40 and/or an opposing area formed between the base portion 81 and the outer surface 400*a* of the patch 40. The distance between the base portion 81 and the outer side surface of the patch 40 may be substantially equal in the first patch portion 401 and the second patch portion 402, or may be different from each other. The length of the base portion 81 and the length of the patch 40 in the X direction are opposed to each other. The length, in other words, the opposing area may be substantially equal in the first patch portion 401 and the second patch portion 402, or may be different from each other. The respective values of the capacitors C5, C6 can be adjusted according to the distance and/or the opposing area (in other words, the opposing length).

In the present embodiment, the base portion 81 is arranged to face the entire region of the adjacent side 40*b*. The base portion 81 is arranged to face the part of the adjacent side 40*b* from the boundary formed with the opposite side 40*d* to the boundary formed with the power feeding side 40*a*. The distance between the base portion 81 and the outer surface 400*a* of the patch 40 is substantially constant over the total length of the base portion 81.

The inserting portion 82 is connected to the base portion 81, and is arranged in the slit 41 to face the inner surface 400*b* of the patch 40. The connecting position of the inserting portion 82 with respect to the base portion 81 is not particularly limited. In the present embodiment, the inserting portion 82 extends in the Y direction. The inserting portion 82 has the substantially rectangular plane shape of which longitudinal direction is the Y direction. The side surface of the inserting portion 82 faces each of the inner surface 400*b* of the first patch portion 401, the inner surface 400*b* of the second patch portion 402 and the inner surface 400*b* of the third patch portion 403. The inserting portion 82 is connected to the central portion of the base portion 81 in the X direction.

With the above-mentioned arrangement, the capacitor C21 is formed between the inner surface 400*b* of the first patch portion 401 and the side surface of the inserting portion 82. The capacitor C22 is formed between the inner surface 400*b* of the third patch portion 403 as the base of the slit 41 and the side surface of the inserting portion 82. The capacitor C23 is formed between the inner surface 400*b* of the second patch portion 402 and the side surface of the inserting portion 82. The parallel circuit of the capacitors C21, C22 and C23 is equivalent to the above-mentioned capacitor C2.

The respective capacitance values of the capacitors C21, C22 and C23 are determined by the distance between the inserting portion 82 and the inner surface 400*b* of the patch 40 and/or an opposing area formed between the inserting portion 82 and the inner surface 400*b* of the patch 40.

For example, the distance between the inserting portion 82 and the inner surface 400*b* may be substantially equal in the first patch portion 401 and the second patch portion 402, or may be different from each other. The respective lengths of the inserting portion 82 and the length of the inner surface 400*b* in the extending direction of the inserting portion 82 are opposed to each other. The opposing length, in other words, the opposing area may be substantially equal in the first patch portion 401 and the second patch portion 402, or may be different from each other. The respective values of the capacitors C21, C22 and C23 can be adjusted according to the distance between the inserting portion 82 and each of the patch portions 401, 402 and 403 and/or the opposing area (in other words, the opposing length). In the present embodiment, the distance between the inserting portion 82 and the inner surface 400*b* is substantially constant over the total length of the opposing area.

The connecting portion 83 is a portion of the additional conductor 80 that electrically connects the other portion, that is, the base portion 81 and the inserting portion 82 to the ground board 30. The connection portion 83 extends from the base portion 81 and includes the inductor L2. As the connecting portion 83, for example, a conductor arranged at the rear surface 20*b* of the main board 20 and connected to the base portion 81, a via conductor connected to the base portion 81 and a combination of the conductor arranged at the rear surface 20*b* and the via conductor may be adopted.

In the present embodiment, the connecting portion 83 is a conductor connected to the base portion 81. The connecting portion 83 is integrally formed with the base portion 81 and the inserting portion 82 by patterning the metal foil. The connecting portion 83 extends from the base portion 81 to a side opposite to the inserting portion 82 in the Y direction. One of the end portions of the connecting portion 83 is connected to the base portion 81. The other one of the end portions of the connecting portion 83 is connected to the ground conductor 71 included in the shield portion 70. The additional conductor 80 has the potential (ground potential) identical to the ground board 30 by connecting the connecting portion 83 electrically to the ground conductor 71. The inductance value of the inductor L2 included in the connecting portion 83 is determined according to the length and width of the conductor in the extending direction.

Figure 7:
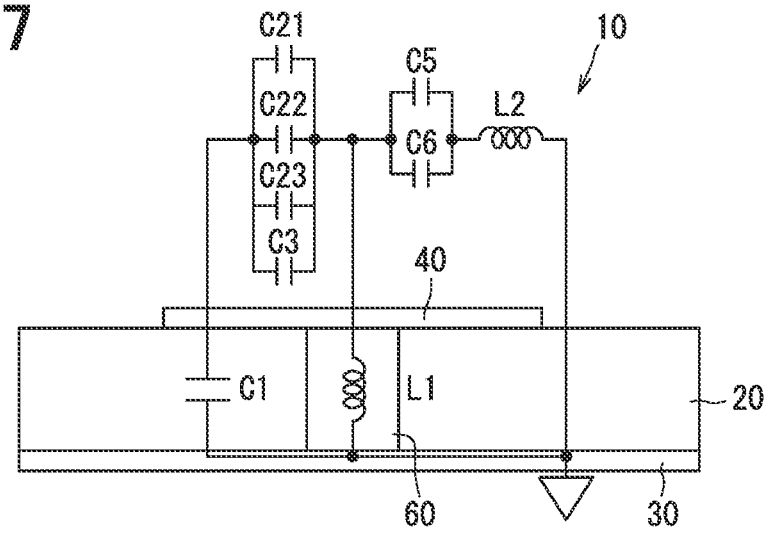
FIG. 7 is an equivalent circuit diagram of the first embodiment.

FIG. 7 is an equivalent circuit diagram of the antenna device 10 according to the present embodiment. In FIG. 7, for convenience, some circuit elements, for example, an inductor included in the patch, are omitted.

As described above, in the present embodiment, the inserting portion 82 of the additional conductor 80 forms the capacitors C21, C22 and C23 with the inner surface 400*b* that defines the slit 41 or 41*b* at the patch 40. By arranging the inserting portion 82 in the slit 41*b*, the capacitor C2 in the reference example of FIG. 5 is replaced with the parallel circuit of the capacitors C21, C22 and C23. As illustrated in FIG. 7, the parallel circuit having the capacitors C3, C21, C22 and C23 is connected between the capacitor C1 and the inductor L1.

The base portion 81 of the additional conductor 80 forms the capacitors C5, C6 with the outer surface 400*a* of the patch 40. The parallel circuit having the capacitors C5 and C6 is connected to the ground board 30 through the inductor L2 of the connecting portion 83. As illustrated in FIG. 7, an LC circuit having the inductor L2 and the capacitors C5 and C6 is formed between the ground board 30 and the patch 40. The LC circuit is connected to the capacitor C1 and the inductor L1 in parallel.

Summary of First Embodiment

Figure 8:
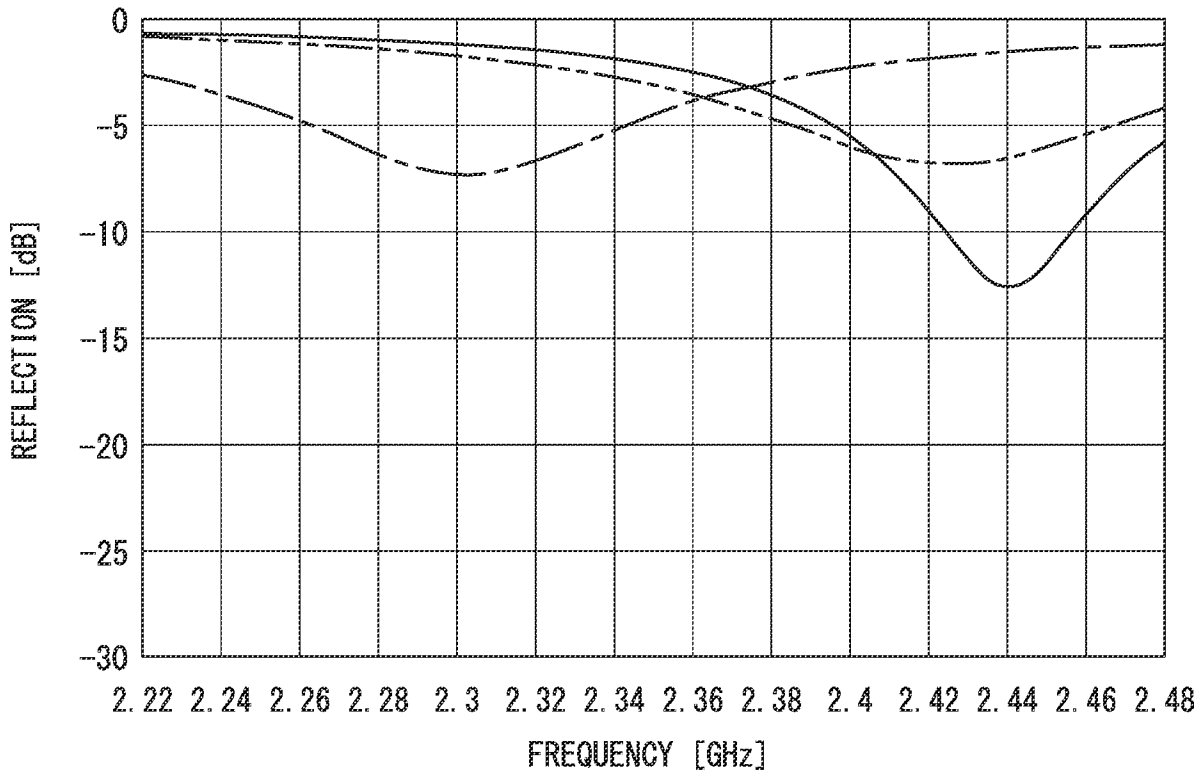
FIG. 8 illustrates the reflection characteristics.

FIGS. 8 to 11 illustrate the results of electromagnetic field simulation of the antenna device at the printed circuit board. FIG. 8 illustrates the reflection characteristics. In FIG. 8, a one-dot chain line and a two-dot chain line respectively indicate the results of the antenna device in the reference examples. The antenna device in the reference example includes the basic structure of the zeroth-order resonant antenna without the slit and the additional conductor. In other words, the antenna device in the reference example has a zeroth-order resonant antenna having a comparative structure. The one-dot chain line indicates the result of the first reference example, and the two-dot chain line indicates the result of the second reference example. The solid line indicates the antenna device 10 in the present embodiment, in other words, the result in the present example. In the reference example and the present embodiment, the operating frequency, the configuration such as dielectric constant and thickness of the main board, and the diameter of the short-circuit portion are the same.

Figure 9:
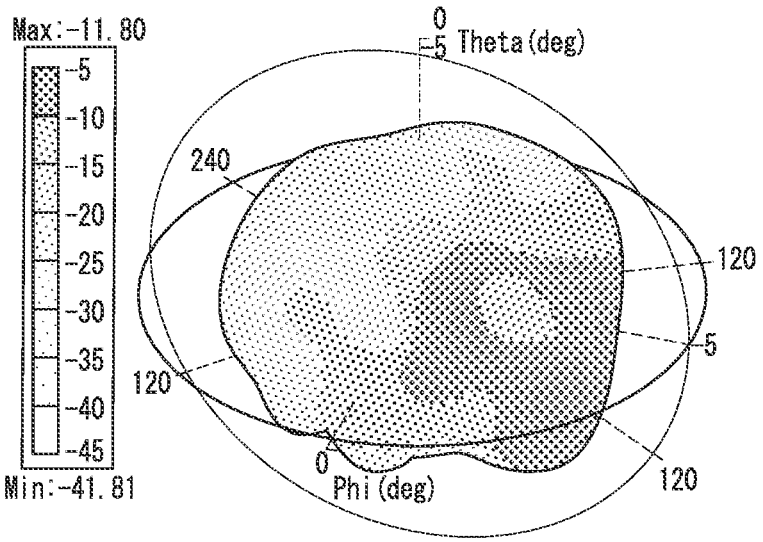
FIG. 9 illustrates radiation characteristics of the first reference example.

The zeroth-order resonant antenna (metamaterial antenna) configured at the printed circuit board may have a change in the frequency band with respect to the resonant frequency of the target due to a variety of reasons such as a change in the dielectric along with the modification of the material of the main board. For the above reason, in the first reference example, the frequency band is deviated from the resonance frequency (2.44 GHz) of the target. As shown in FIG. 8, the frequency band of the first reference example is shifted to the lower frequency side with respect to the target. FIG. 9 indicates the reflection characteristics (electrical field distribution) in the first reference example. The maximum gain of the first reference example was −11.8 dB at 2.44 GHz. The antenna gain is reduced due to the deviation of the frequency band.

The zeroth-order resonant antenna having the basic structure at the printed circuit board operates by LC parallel resonance between the inductor L1 of the via conductor included in the short-circuit portion and the capacitor C1 formed between the patch and the ground board. The inductor L1 is determined by the thickness of the main board and the via diameter, and the capacitor C1 is determined by the size of the patch and the thickness of the main board. The thickness of the main board is limited by other circuit configurations formed at the printed circuit board. As described above, there are few parameters that determine the resonance frequency.

The size of the patch, the via diameter of the short-circuit portion, and the size of the ground board are adjusted to enhance the reflection characteristics. To change the size of the antenna, it is necessary to consider the circuit layout around the antenna at the printed circuit board. Further, the via diameter cannot be made smaller than a predetermined diameter because it is restricted by processing such as a drill. When the frequency is shifted to the low frequency side with respect to the target as in first reference example, the resonance frequency cannot be increased unless the size of the patch portion is reduced.

Figure 10:
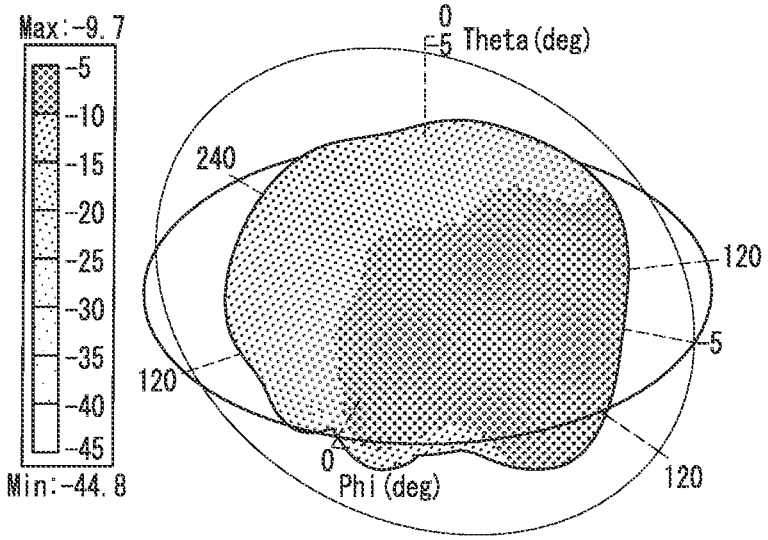
FIG. 10 illustrates radiation characteristics of the second reference example.

In the second reference example, the size of the patch is smaller than that of the first reference example in order to increase the resonance frequency. As described above, when the size of the patch is reduced, not only the opposing area formed between the patch and the ground board but also the value of the capacitor C1 becomes smaller. As a result, the resonance frequency of the second reference example is shifted to the higher frequency side with respect to the first reference example as shown in FIG. 8. On the other hand, since the radiation area decreases, the gain of the antenna decreases. FIG. 10 illustrates the reflection characteristics in the second reference example. The maximum gain of the second reference example was −9.7 dB at 2.44 GHz due to the decrease in radiation area even though the resonance frequency was shifted to the vicinity of the target.

Since the zeroth-order resonant antenna has a maximum gain lower than the first-order resonant antenna, it may be desirable to change the design without decreasing the original gain. Since the via diameter is often limited in processing, the size of the patch is the main parameter for adjusting the resonance frequency and enhancing the reflection characteristics in the zeroth-order resonance antenna having the basic structure. Therefore, it affects the antenna gain.

On the other hand, according to the antenna device 10 in the present embodiment, the additional conductor 80 is added to the basic structure of the zeroth-order resonant antenna. A capacitor is formed at a portion where the base portion 81 of the additional conductor 80 faces the outer surface 400*a* of the patch 40. The connecting portion 83 of the additional conductor 80 includes an inductor. Since new parameters are added in the LC parallel resonant circuit, the degree of freedom in designing the antenna device 10 is enhanced. While configuring the size of the patch 40 identical to the one in the first reference example, the resonance frequency can be shifted to the higher frequency side as shown in FIG. 8 to match the target. In other words, the resonance frequency can be shifted to the higher frequency side without reducing the size of the patch 40.

The patch 40 is provided with a slit 41. Since the area of the patch 40 is reduced by the slit 41, the capacitance value of the capacitor C1 is reduced. On the other hand, the slit 41 connects the capacitor between the capacitor C1 and the inductor L1 as shown in the above-mentioned reference example in FIG. 5. Therefore, the parameters for determining the entire capacitors increase. By providing the slit 41, the degree of freedom in designing the antenna device 10 is enhanced. It is possible to enhance the reflection characteristics as compared with a situation of having no slit 41.

In the present embodiment, the inserting portion 82 of the additional conductor 80 is arranged inside the slit 41. Multiple capacitors are formed at a portion where the inserting portion 82 of the additional conductor 80 faces the inner surface 400*b* of the patch 40. As a result, the parameters can be further increased, and the degree of freedom in designing the antenna device 10 can be further enhanced. Therefore, as shown in FIG. 8, the reflection characteristics can be further enhanced. According to the present embodiment, the reflection characteristics can be further enhanced as compared with the configuration in which the inserting portion is not arranged in the slit as shown in FIG. 5.

Figure 11:
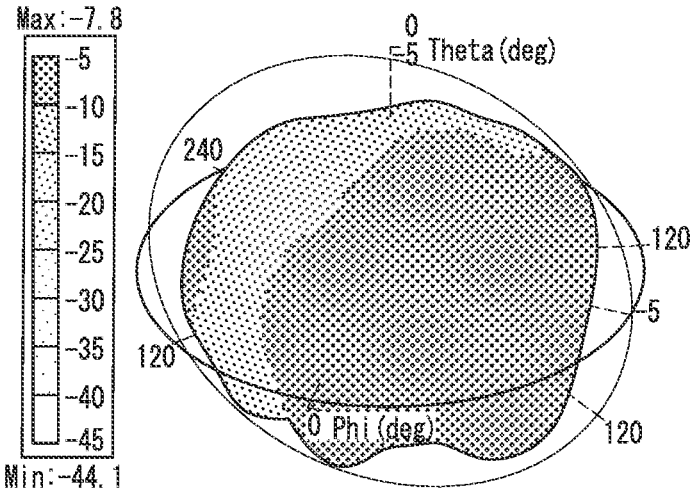
FIG. 11 illustrates radiation characteristics of the first embodiment.

According to the antenna device 10 in the present embodiment, it is possible to enhance the reflection characteristics while shifting the resonance frequency to the higher resonance frequency side without changing the physical size of the patch 40. Since the physical size (outer contour) of the patch 40 is not changed, it is possible to enhance the antenna gain. FIG. 11 illustrates the radiation characteristics in the present example. The maximum gain of the present example was −7.8 dB at 2.44 GHz.

In the present embodiment, the patch 40 having a substantially square planar shape includes a slit 41*b* and a slit 41*c*. The slit 41*b* has an aperture opening to the adjacent side 40*b*, and the slit 41*c* has an aperture opening to the adjacent side 40*c*. The effect of enhancing the reflection characteristics is higher in a situation where the slit 41 is provided on at least one of the adjacent sides 40*b* and 40*c* as compared with a situation where the slit 41 is provided at the opposite side 40*d*. The slits 41*b* and 41*c* correspond to adjacent slits.

In the present embodiment, the inserting portion 82 of the additional conductor 80 is arranged at only the slit 41*b* from both of the slits 41*b* and 41*c*. According to this situation, the electric field distribution is biased to the side where the inserting portion 82 is provided, and the directivity can be biased to the slit 41*b* side in the Y direction. In the present embodiment, the power feeder 50 has a substantially L-shaped planar shape, and has a portion extending in the Y direction toward the slit 41*b*. As a result, the directivity is biased toward the slit 41*b* in the Y direction. A synergistic effect of the arrangement of the power feeder 50 and the arrangement of the inserting portion 82 can be anticipated. The slit 41*b* corresponds to a first adjacent slit, and the slit 41*c* corresponds to a second adjacent slit.

In the present embodiment, the base portion 81 is arranged to face the outer surface 400*a* across the aperture of the slit 41*b*. In other words, the base portion 81 is arranged to face the outer surface 400*a* of the first patch portion 401 and the outer surface 400*a* of the second patch portion 402. As a result, the above-mentioned capacitors C5 and C6 are formed. With an increase in the parameters, it is possible to enhance the degree of freedom in designing the antenna device 10. Since finer adjustment is possible by enhancing the degree of freedom in design, it is easier to match the resonance frequency with the resonance frequency of the target.

In the present embodiment, the connecting portion 83 includes a conductor connected to the base portion 81. In other words, at least a portion of the connecting portion 83 closer to the base portion 81 is disposed at a surface at which the base portion 81 is disposed. As a result, the distance between the base portion 81 and the outer surface 400*a* of the patch 40 can be narrowed as compared with the configuration in which the via conductor of the connecting portion 83 is connected to the base portion 81. Accordingly, it may be possible to improve freedom of design of the antenna device 10.

Figure 12:
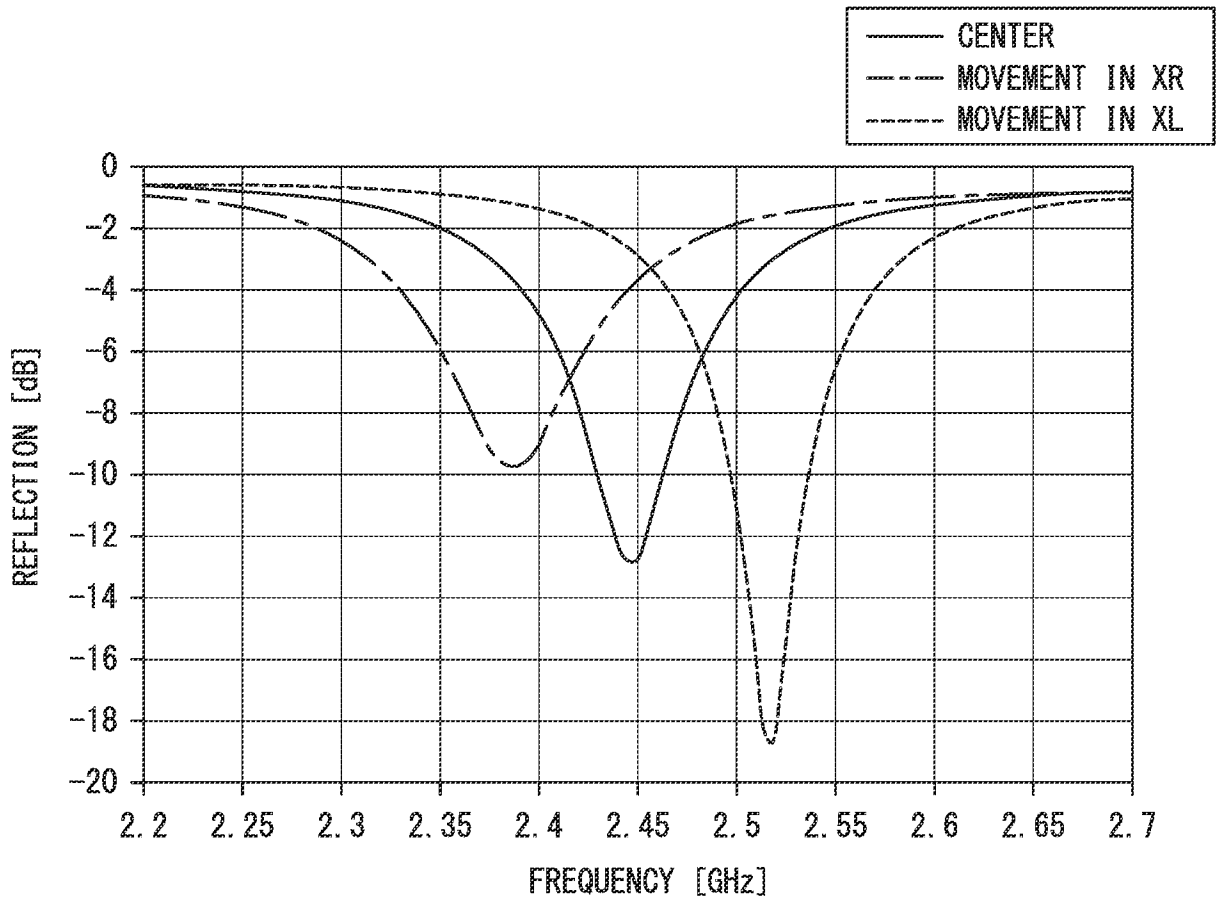
FIG. 12 illustrates a relationship between a position of a connecting portion and reflection characteristics.
Figure 13:
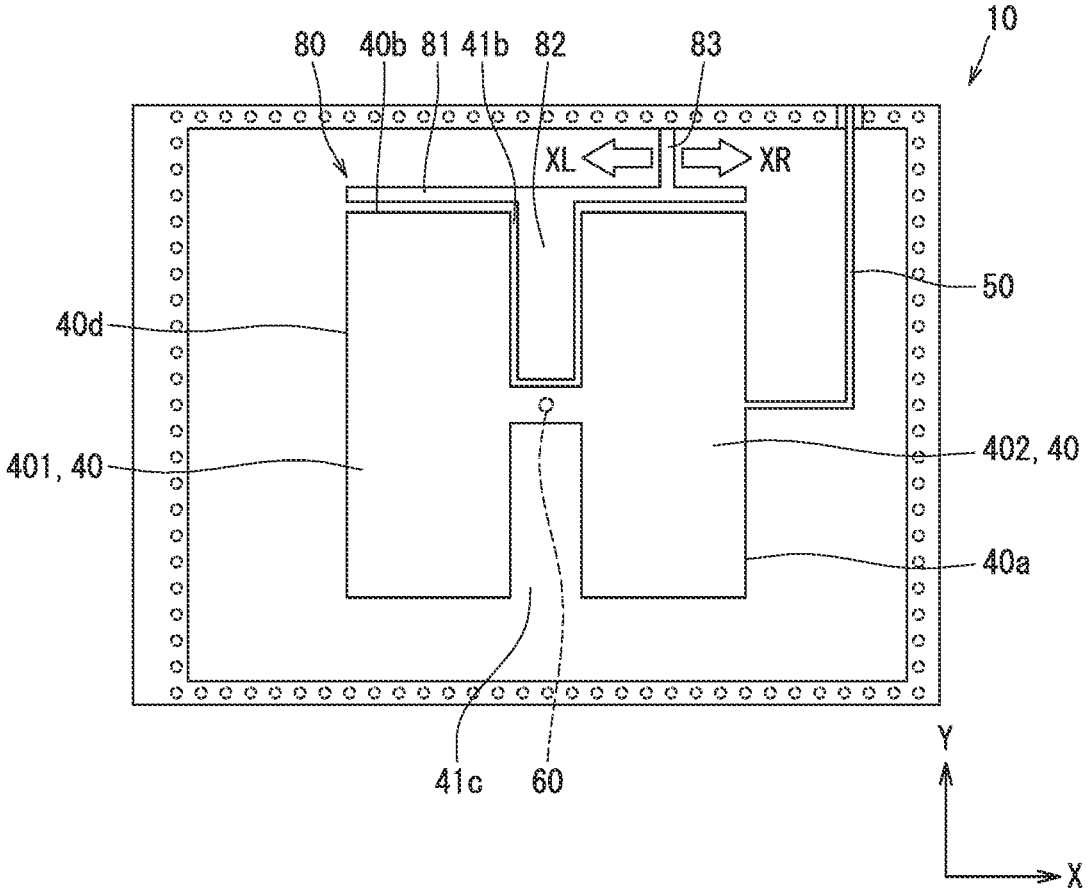
FIG. 13 illustrates an arrangement of the connecting portion.

FIG. 12 indicates a change in the reflection characteristics depending on the position of the connecting portion 83 in the antenna device 10. FIG. 13 illustrates the arrangement of the connecting portion 83 with respect to the base portion 81. In the electromagnetic field simulation, the center of the portion of the second patch portion 402 facing the base portion 81 in the X direction was set as the reference position of the connecting portion 83. The center illustrated in FIG. 12 indicates the reflection characteristics in a situation where the connecting portion 83 is adopted as a reference position. The movement to XR shown in FIG. 12 indicates the reflection characteristics in a situation where the connecting portion 83 is moved from the reference position by a predetermined distance in XR direction as shown in FIG. 13. The movement to XL shown in FIG. 12 indicates the reflection characteristics in a situation where the connecting portion 83 is moved from the reference position by a predetermined distance in XL direction as shown in FIG. 13. The XR direction is a direction from the reference position toward the power feeding side 40*a* in the X direction. The XL direction is a direction from the reference position toward the opposite side 40*d* in the X direction. In the electromagnetic field simulation, the base portion 81 has a length substantially equal to the adjacent side 40*b* of the patch 40.

In a situation where the connecting portion 83 is set closer to XR from the reference position, the high-frequency shifting amount of the resonance frequency is smaller than the reference position as indicated by a one-dot chain line in FIG. 12. In a situation where the connecting portion 83 is set closer to XL from the reference position, the high-frequency shifting amount of the resonance frequency is larger than the reference position as indicated by a broken line in FIG. 12. In a situation where the connecting portion 83 moves to the XR side, the distance from the short-circuit portion 60 to the connecting part where the ground conductor 71 is connected to the connecting portion 83 becomes longer. In other words, the connecting part is a ground connecting portion at the additional conductor 80. As a result, the high-frequency shifting amount decreases. In a situation where the connecting portion 83 moves to the XL side, the distance from the short-circuit portion 60 to a connecting part where the ground conductor 71 is connected to the connecting portion 83 becomes longer, and the high-frequency shifting amount decreases.

In other words, in a situation where the connecting portion 83 is connected closer to the short-circuit portion 60 than the end portion of the base portion 81 in the extending direction, in other words, the X direction, it is possible to further increase the high-frequency shifting amount. In a situation where the connecting portion 83 is connected to the end part of the base portion 81 in the extending direction, it is possible to decrease the high-frequency shifting amount.

Modified Example

Figure 14:
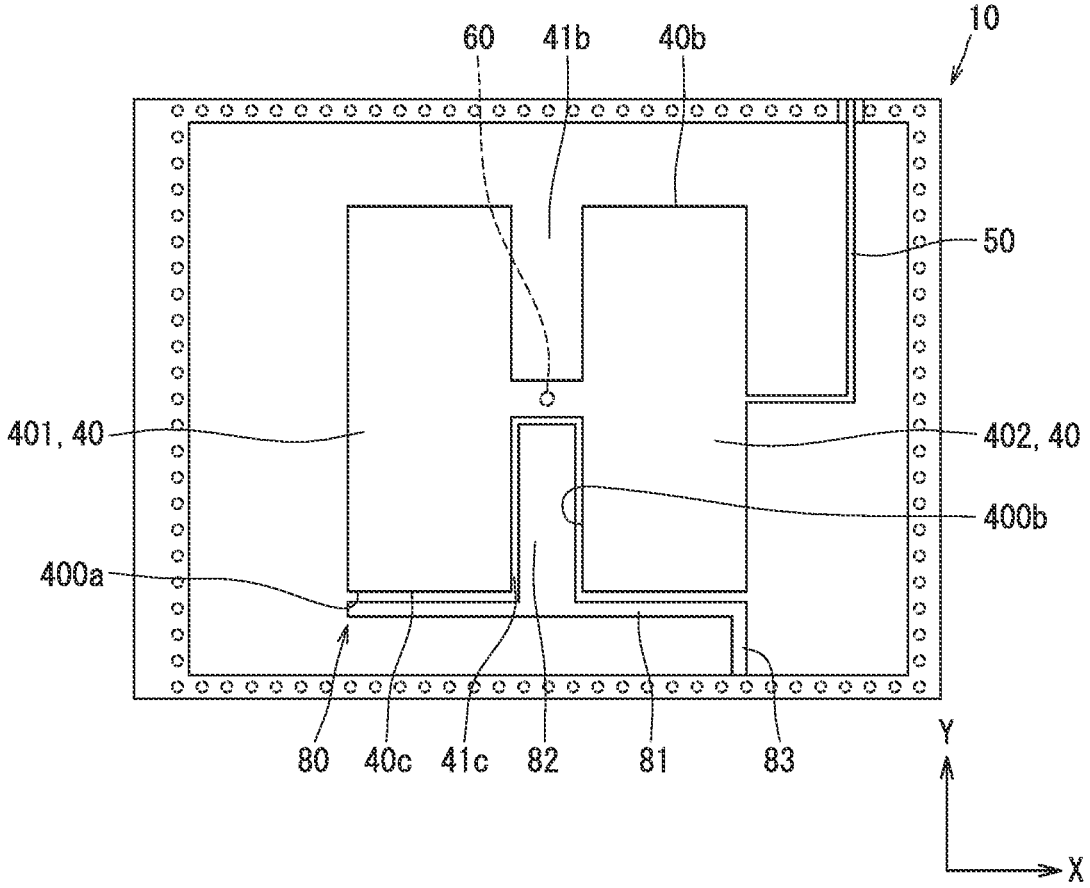
FIG. 14 is a plan view showing a modified example.

The above describes an example in which the inserting portion 82 of the additional conductor 80 is arranged at the slit 41*b* of the adjacent side 40*b*, the present disclosure is not limited to this situation. For example, as shown in the modified example in FIG. 14, the additional conductor 80 may also be provided at the slit 41*c* in the configuration where the patch 40 has two slits 41*b*, 41*c*. In FIG. 14, the base portion 81 of the additional conductor 80 faces the outer surface 400*a* of the adjacent side 40*c*. The inserting portion 82 is arranged in the slit 41*c* and faces the inner surface 400*b*. The connecting portion 83 extends from the base portion 81 to the side away from the patch 40 in the Y direction.

Figure 15:
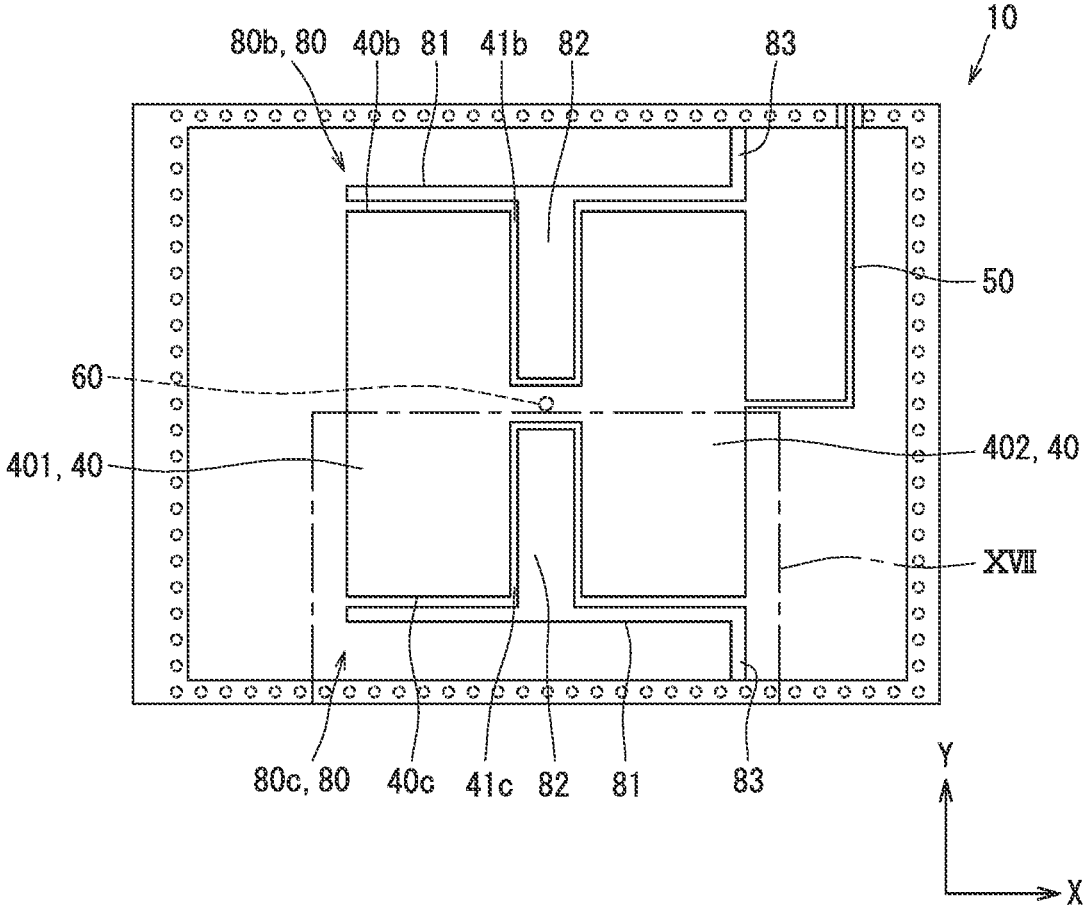
FIG. 15 is a plan view illustrating a modified example.

As shown in the modified example of FIG. 15, the additional conductor 80 may be arranged at each of the two slits 41*b*, 41*c*. The antenna device 10 includes two additional conductors 80*b* and 80*c*. The inserting portion 82 of the additional conductor 80*b* is arranged at the slit 41*b*. The inserting portion 82 of the additional conductor 80*c* is arranged at the slit 41*c*.

Figure 16:
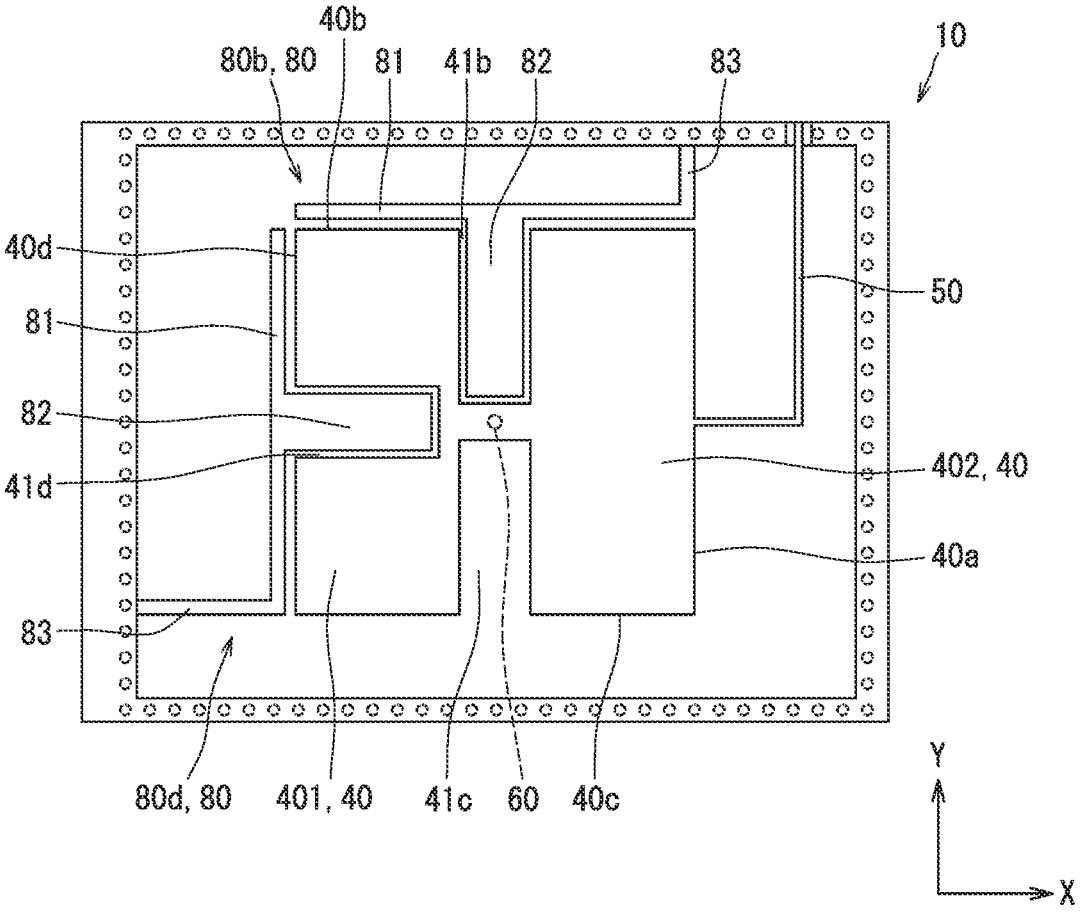
FIG. 16 is a plan view illustrating a modified example.

As shown in the modified example of FIG. 16, the patch 40 may have a slit 41*d* having an aperture opening to the opposite side 40*d*. The antenna device 10 may include the additional conductor 80*d* at the slit 41*d*. The inserting portion 82 of the additional conductor 80*d* is arranged at the slit 41*d*. In FIG. 16, the patch 40 has three slits 41*b*, 41*c*, and 41*d*. In the present embodiment, the additional conductor 80 is arranged at the two slits 41*b*, 41*c* among the three slits 41*b*, 41*c*, and 41*d*. Although only the slit 41*d* may be provided, the slits 41*b* and 41*c* that respectively have apertures opening to the adjacent sides 40*b* and 40*c* are more effective in enhancing the reflection characteristics.

Figure 17:
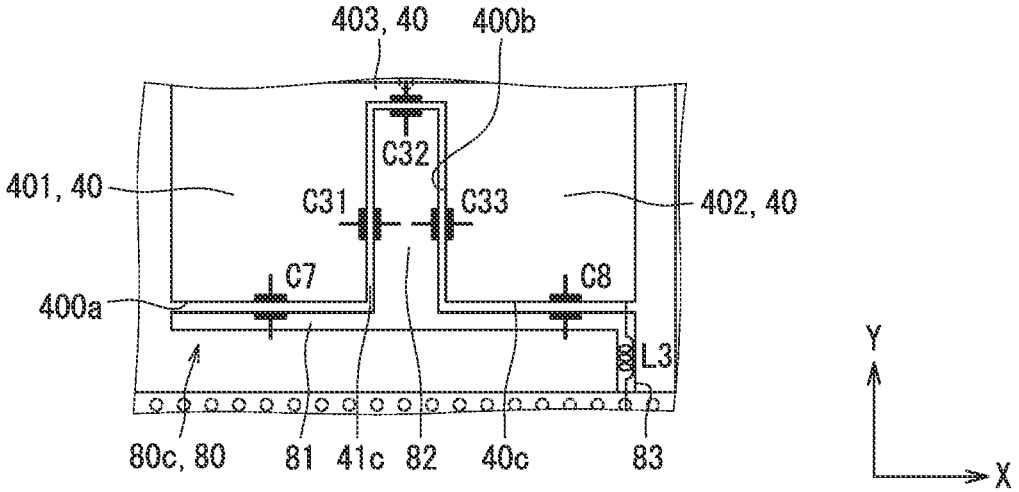
FIG. 17 is a diagram in which region XVII of FIG. 15 is enlarged.

FIG. 17 is a diagram in which region XVII of FIG. 15 is enlarged. As shown in FIG. 17, capacitors C7, C8, C31, C32, and C33 are formed between an additional conductor 80*c* and the patch 40. The capacitor C7 is formed between the base portion 81 and the outer surface 400*a* of the first patch portion 401. The capacitor C8 is formed between the base portion 81 and the outer surface 400*a* of the second patch portion 402. The capacitor C31 is formed between the inserting portion 82 and the inner surface 400*b* of the first patch portion 401. The capacitor C32 is formed between the inserting portion 82 and the inner surface 400*b* of the third patch portion 403. The capacitor C33 is formed between the inserting portion 82 and the inner surface 400*b* of the second patch portion 402. The connecting portion 83 includes the inductor L3.

Figure 18:
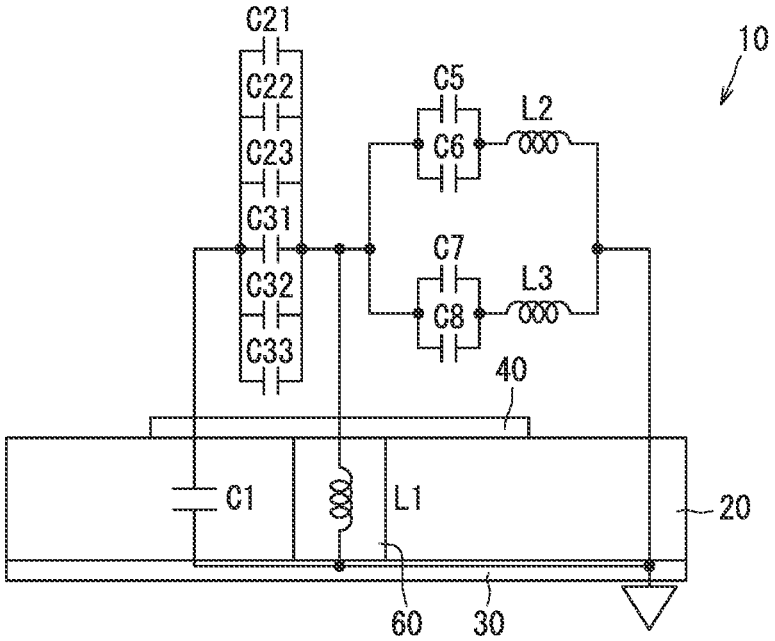
FIG. 18 is an equivalent circuit diagram of the modified example illustrated in FIG. 15.

FIG. 18 is an equivalent circuit diagram of the modified example illustrated in FIG. 15. With the addition of the additional conductor 80*c*, the capacitor C3 is replaced with a parallel circuit having the capacitors C31, C32 and C33. The parallel circuit having the capacitors C21, C22, C23, C32 and C33 is connected between the capacitor C1 and the inductor L1. An LC circuit having the inductor L3 and the capacitors C7 and C8 is formed between the ground board 30 and the patch 40. The LC circuit having the inductor L3 and the capacitors C7, C8 is connected in parallel to the LC circuit having the inductor L2 and the capacitors C5, C6. Since the parameters are further increased by increasing the number of additional conductor 80, it is possible to enhance the degree of freedom in designing the antenna device 10.

Figure 19:
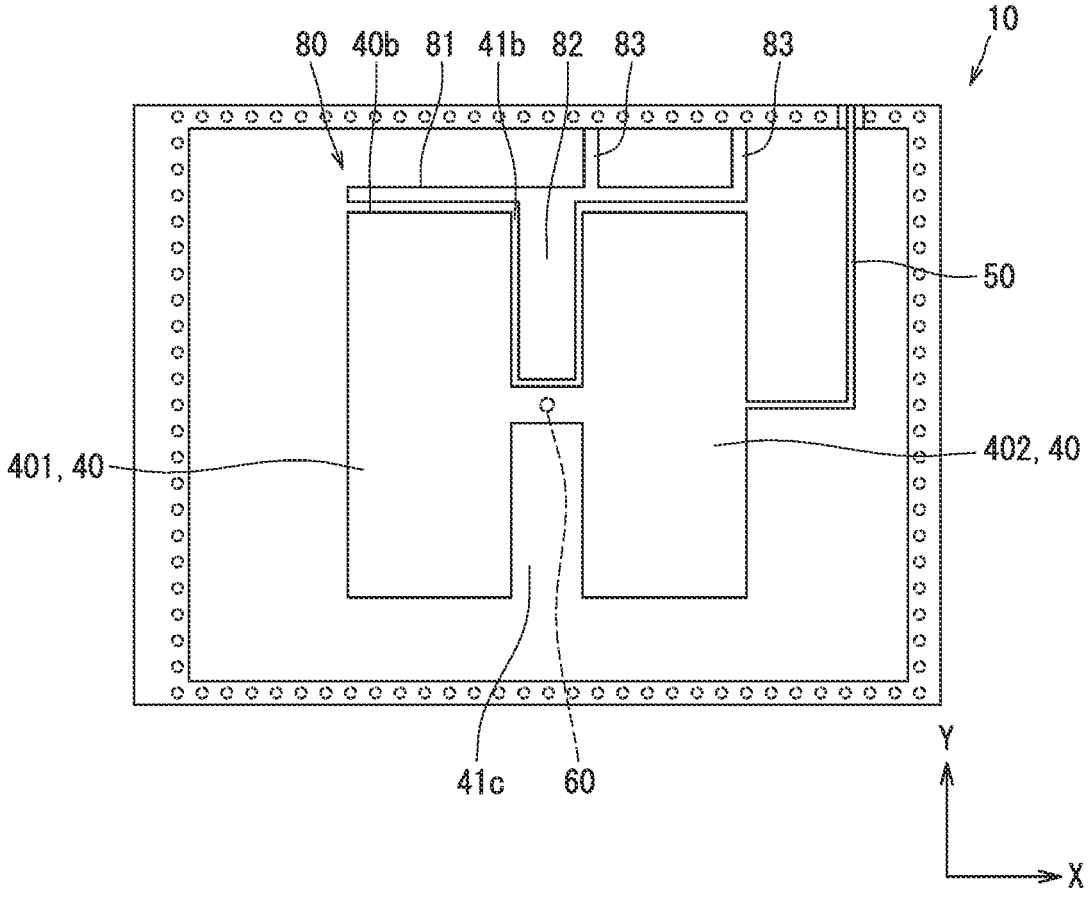
FIG. 19 is a plan view illustrating a modified example.

As shown in the modified example of FIG. 19, one additional conductor 80 may have multiple connecting portions 83. In FIG. 19, two connecting portions 83 are connected to one base portion 81. The base portion 81 and the connecting portion 83 have a substantially F-shaped planar shape.

Figure 20:
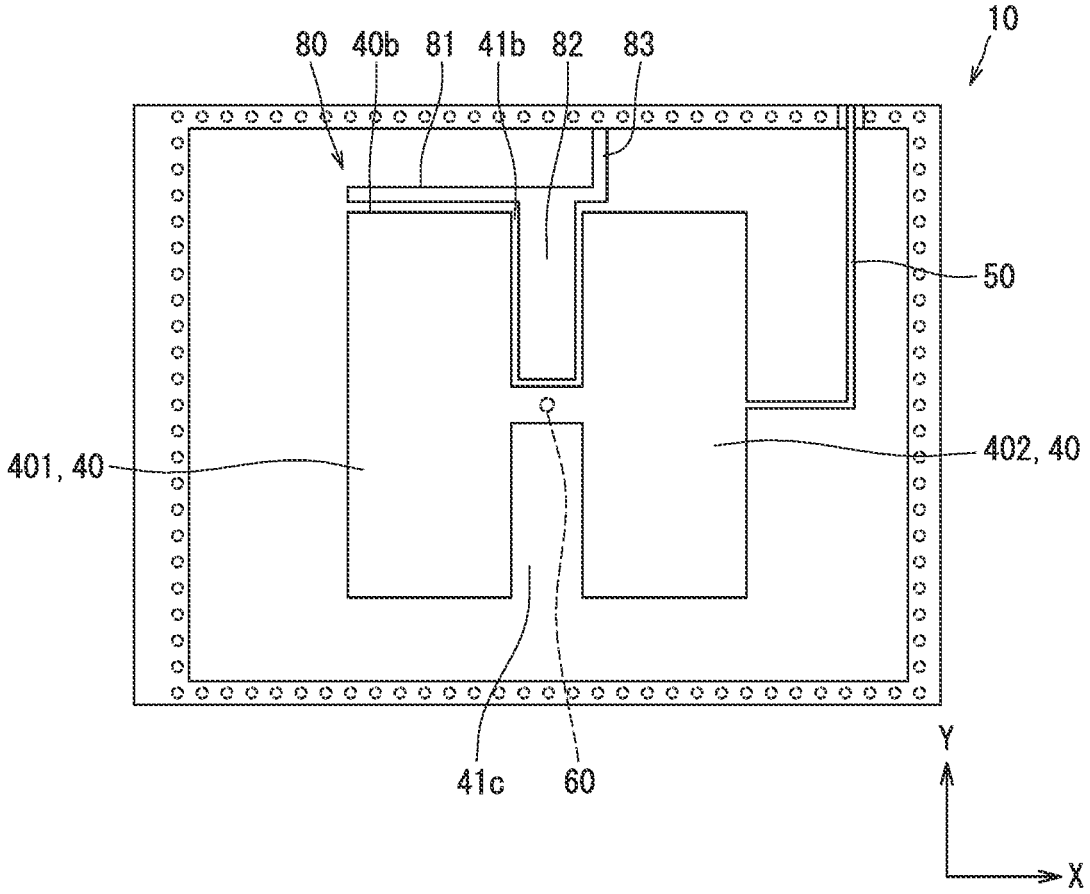
FIG. 20 is a plan view illustrating a modified example.

As shown in the modified example of FIG. 20, the extended length of the base 81 may be shorter than the length of the side where the slit 41 opens. In FIG. 20, the extended length of the base 81 is shorter than the length of the adjacent side 40*b*. The base portion 81 faces the entire region of the first patch portion 401 at the adjacent side 40*b*, and faces only a part of the second patch portion 402 at the adjacent side 40*b*. Since the opposed area formed between the base portion 81 and the second portion 402 is smaller, the capacitance value of the capacitor C6 becomes smaller.

Figure 21:
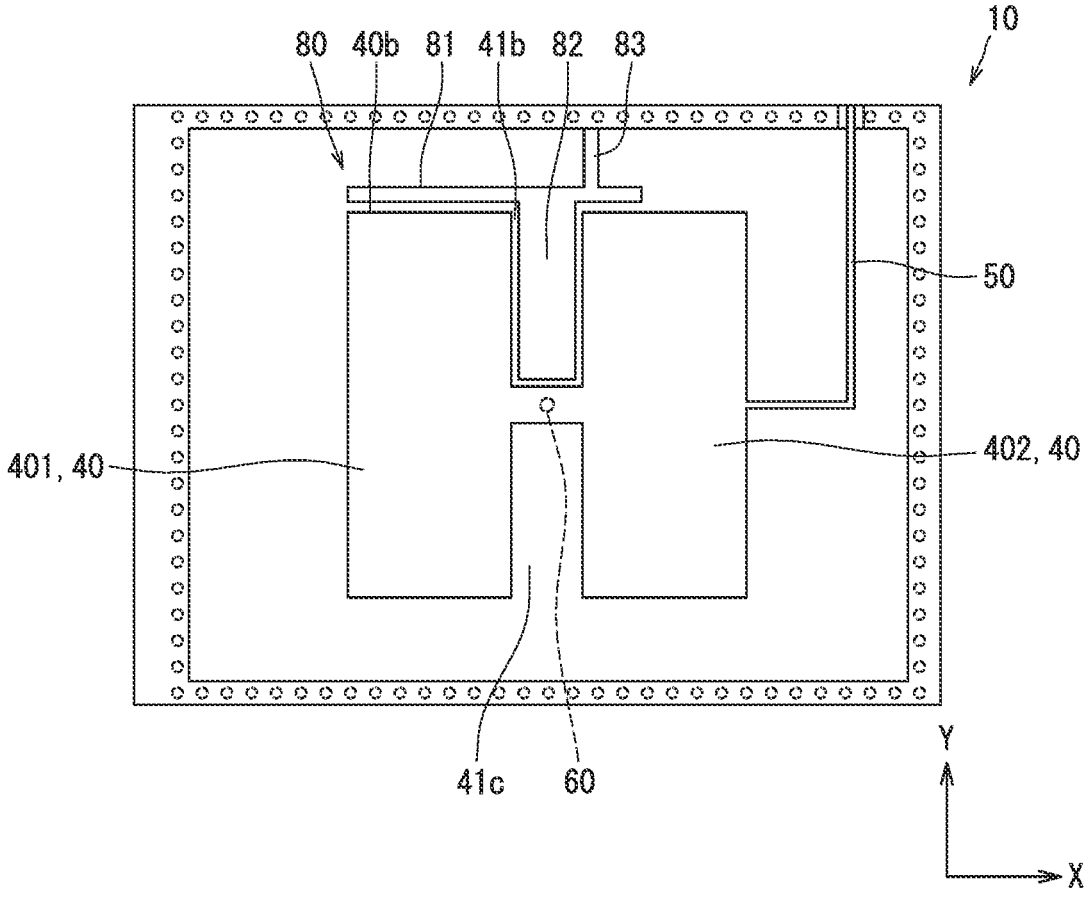
FIG. 21 is a plan view illustrating a modified example.

In FIG. 20, the connecting portion 83 is connected to the end portion of the base portion 81 in the extending direction of the base portion 81. On the other hand, as shown in the modified example of FIG. 21, the connecting portion 83 may be connected to a position closer to the short-circuit portion 60 than the end portion of the base portion 81 in the extending direction. As described above, it is possible to further increase the high-frequency shifting amount.

Figure 22:
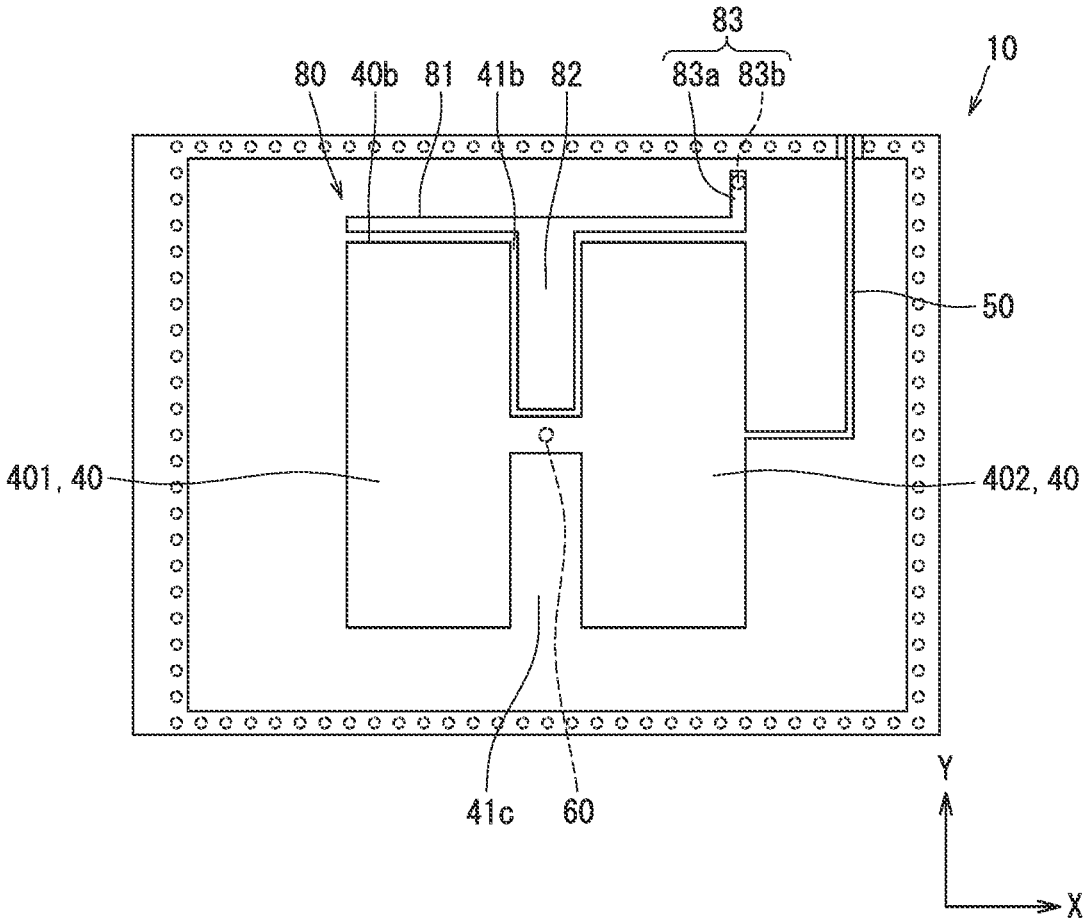
FIG. 22 is a plan view illustrating a modified example.

As in the modified example of FIG. 22, the connecting portion 83 of the additional conductor 80 may include a conductor 83*a* arranged at the rear surface 20*b* and a via conductor 83*b*. Although not shown, the connecting portion 83 may only include the via conductor 83*b* and exclude the conductor 83*a*.

Second Embodiment

A second embodiment is a modification of the preceding embodiments as a basic configuration and may incorporate the description of the preceding embodiments. In the prior embodiment, the power feeder 50 is connected to the patch 40. Instead, the power feeder 50 may form a capacitor with the patch 40.

Figure 23:
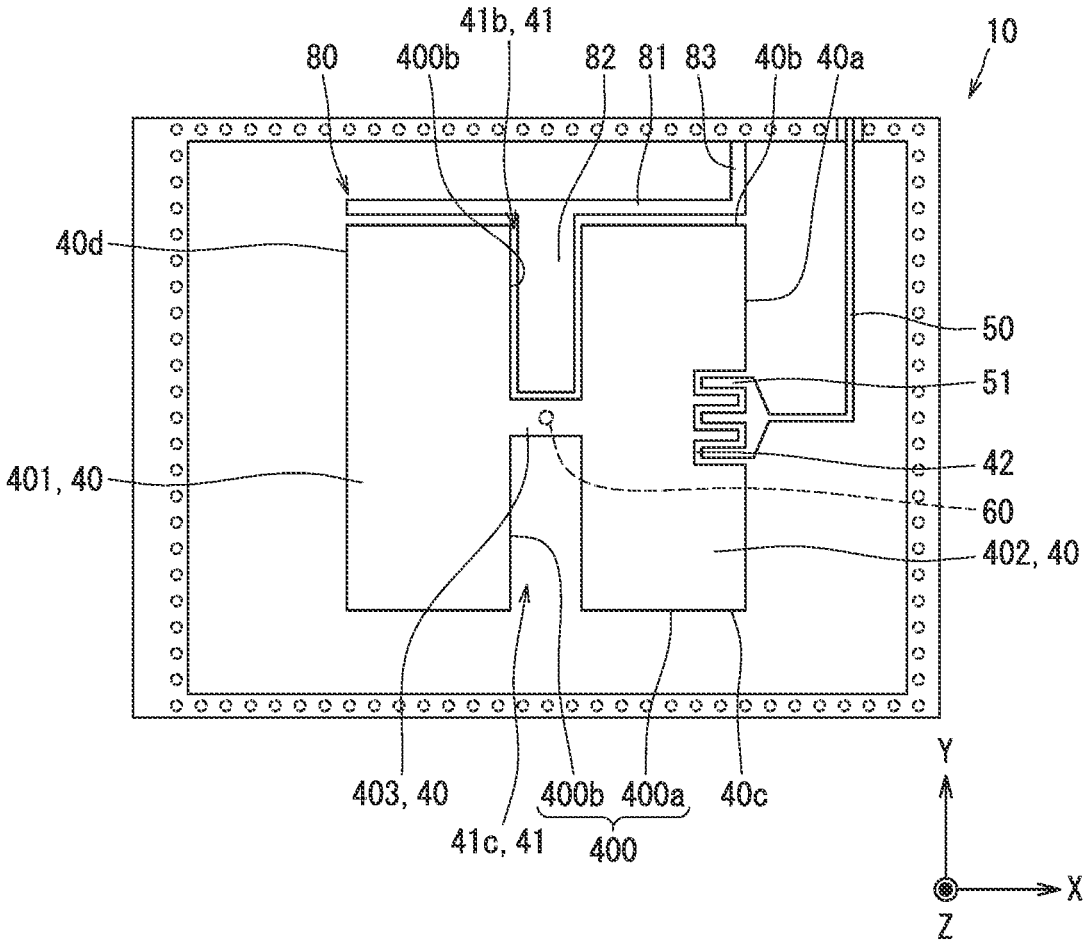
FIG. 23 is a plan view showing an antenna device according to a second embodiment.
Figure 24:
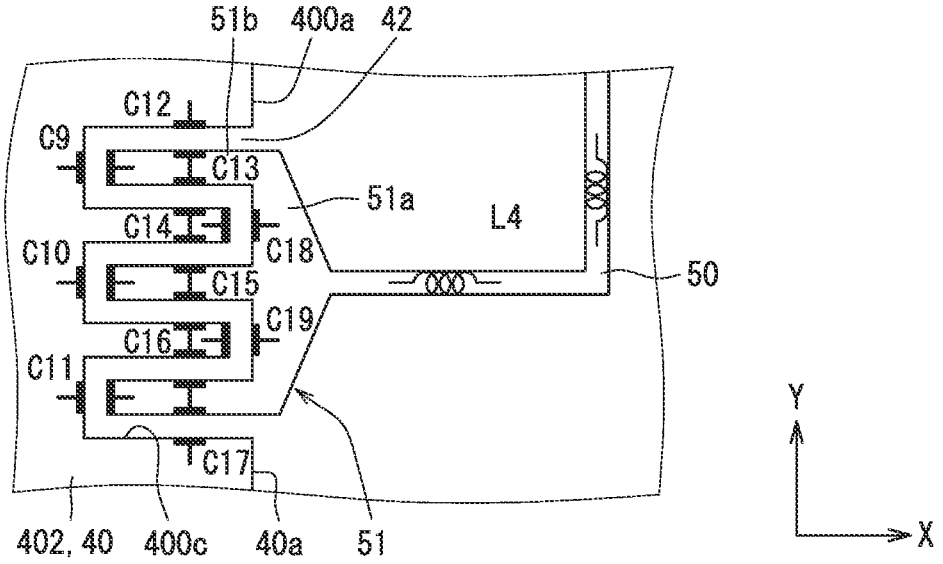
FIG. 24 is a diagram in which region XXIV of FIG. 23 is enlarged.

FIG. 23 illustrates the antenna device 10 according to the present embodiment. FIG. 24 is a diagram in which region XXIV of FIG. 23 is enlarged. As illustrated in FIGS. 23 and 24, the power feeder 50 is not connected to the patch 40 in the antenna device 10 according to the present embodiment. The power feeder 50 forms a capacitor with the patch 40, and is electrically connected to the patch 40 through this capacitor. The power feeder 50 has a branch portion 51. The branch portion 51 is provided at the end portion of the power feeder 50 near the patch 40. The branch portion 51 is branched into several branches. In the present embodiment, the branch portion 51 is branched into three branches. The branch portion 51 includes a base 51*a* and three protrusions 51*b* extending from the base 51*a* in the X direction.

The second patch portion 402 of the patch 40 includes a notch 42 for individually accommodating each of the protrusions 51*b* of the branch portion 51. The notch 42 has an aperture opening to the outer surface 400*a* of the patch 40. The side surface 400 has an inner surface 400*c* that defines or specifies the notch 42. The inner surface 400*c* is connected to the outer surface 400*a* of the power feeding side 40*a*. The notch 42 includes three recesses for respectively accommodating the protrusions 51*b*, and includes two protrusions between the adjacent recesses.

The branch portion 51 is arranged to face the inner surface 400*c* with a predetermined distance. With the above-mentioned arrangement, capacitors C9, C10 and C11 are formed between the respective tip surfaces of the protrusions 51*b* and the inner surface 400*c* forming the bottom of the recess. Capacitors C12, C13, C14, C15, C16, and C17 are formed between the both side surfaces of the protrusions 51*b* and the inner surface 400*c*. Capacitors C18 and C19 are formed between the base 51*a* and the inner surface 400*c* forming the tip of the protrusion. The branch portion 51 passes through the short-circuit portion 60 in a plan view, and is linearly symmetric with respect to a virtual straight line parallel to an X-axis. Similarly, the notch 42 is linearly symmetric with respect to the above-mentioned virtual straight line. The power feeder 50 includes an inductor L4. Since the other configurations are similar to the configurations described in the preceding embodiment, the description of the other configurations is not described in the following.

Figure 25:
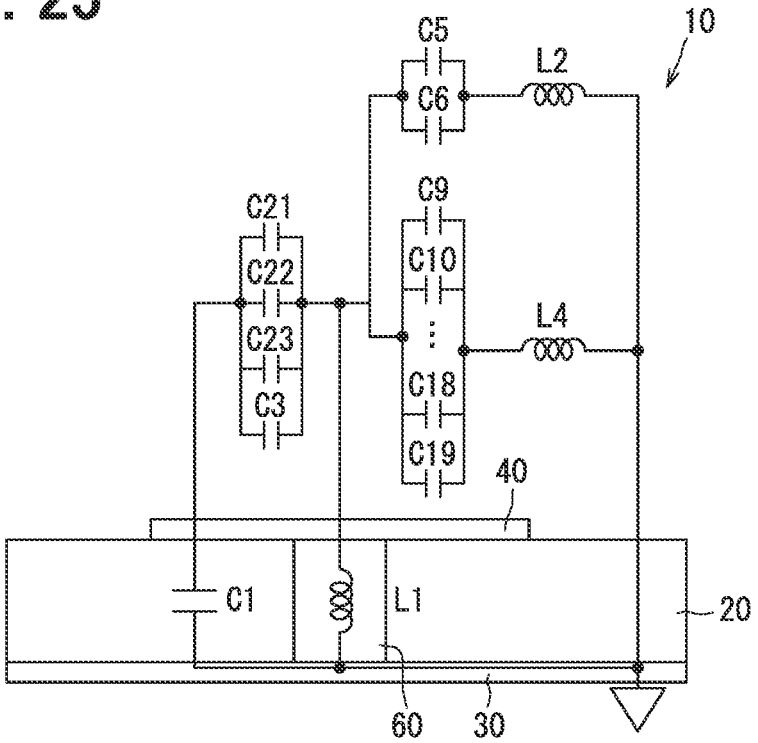
FIG. 25 illustrates an equivalent circuit diagram.

FIG. 25 is an equivalent circuit diagram of the antenna device 10 according to the present embodiment. As described above, in the present embodiment, the power feeder 50 includes the inductor L4. The branch portion 51, which is provided at the end portion of the power feeder 50, forms capacitors C9 to C19 with the inner surface 400*c* of the patch 40. These capacitors C9 to C19 are connected in parallel to each other. The LC circuit having the inductor L4 and the capacitors C9 to C19 is connected in parallel to the LC circuit having the inductor L2 and the capacitors C15, C6.

Summary of Second Embodiment

Figure 26:
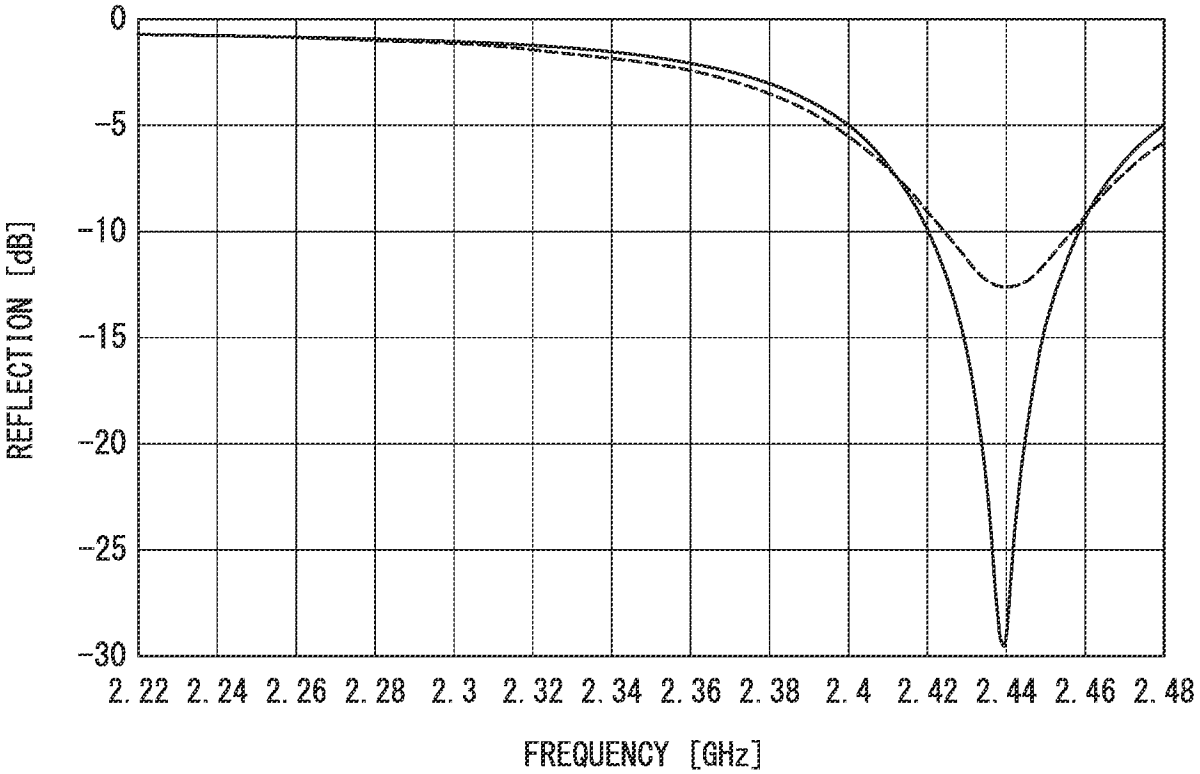
FIG. 26 illustrates the reflection characteristics.

FIG. 26 illustrates the results, in other words, the reflection characteristics of electromagnetic field simulation of the antenna device 10 according to the present embodiment. In FIG. 26, the result of the preceding embodiment is shown by a broken line as a reference example. The results of the preceding embodiment correspond to the solid line in FIG. 8. The solid line indicates the results of the antenna device 10 in the present embodiment. In the electromagnetic field simulation of the present embodiment, the configuration such as the dielectric constant and the thickness of the main board and the diameter of the short-circuit portion are identical to those of the simulation of the preceding embodiment.

The antenna device 10 according to the present embodiment includes the patch 40 having the slit 41 and the additional conductor 80. Therefore, it is possible to generate an advantageous effect identical to the configuration described in the first embodiment. In other words, it is possible to enhance the reflection characteristics while shifting the resonance frequency to the higher resonance frequency side without changing the physical size of the patch 40.

The power feeder 50 forms a capacitor or capacitance with the patch 40. The capacitance value of the capacitor is sufficiently small as compared with the capacitors C5, C6 near the additional conductor 80 to be connected in parallel with the capacitor. As compare with the total number of capacitors included in respective LC circuits, the capacitance value of the capacitor near the power feeder 50 is, for example, about 1/50 to 1/1000 of the capacitance value of the capacitor near the additional conductor 80. The inductance value of the inductor L4 included in the power feeder 50 is sufficiently small as compared with the inductor L2 included in the connecting portion 83 of the additional conductor 80. Therefore, the LC circuit near the power feeder 50 enhances the impedance matching with the antenna, in other words, the reflection characteristics, but without having a remarkable enhancement on the high-frequency shift.

Figure 27:
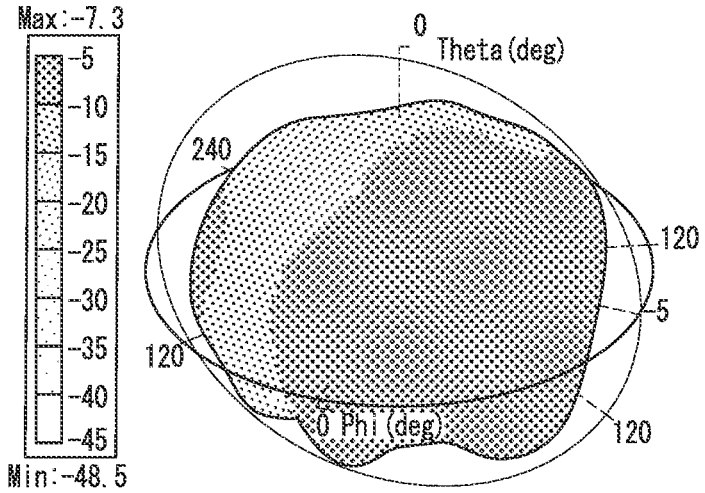
FIG. 27 illustrates the radiation characteristics.

Since new parameters are added in the LC parallel resonant circuit, the degree of freedom in designing the antenna device 10 is enhanced. In other words, as illustrated in FIG. 26, it is possible to enhance the reflection characteristics while shifting the resonance frequency to the higher resonance frequency side without changing the physical size of the patch 40. FIG. 27 illustrates the radiation characteristics in the present example. The maximum gain of the present example was −7.3 dB at 2.44 GHz.

In the present embodiment, the power feeder 50 includes the branch portion 51 at the end portion near the patch 40. The branch portion 51 forms capacitors C9 to C19 with the inner surface 400*c* included in the notch 42 of the patch 40. With an increase in the parameters, it is possible to enhance the degree of freedom in designing the antenna device 10. Since it is possible to have a fine adjustment with the enhancement in the degree of freedom in design, it is possible to further enhance the reflection characteristics.

Modified Example

Figure 28:
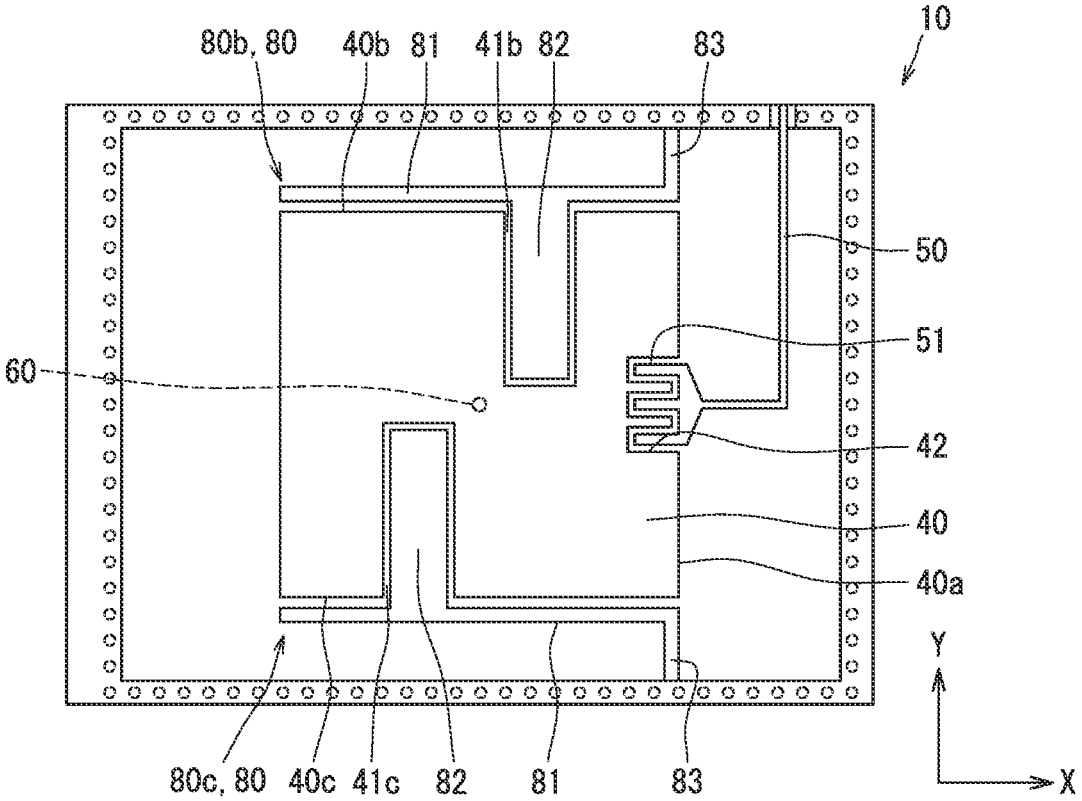
FIG. 28 is a plan view illustrating a modified example.

The shape, size, arrangement, and number of slits 41 and additional conductors 80 are not limited to the above examples. Combinations with the configuration described in the preceding embodiment are also possible. For example, as shown in the modified example of FIG. 28, the connecting structure in which the power feeder 50 and the patch 40 are connected may be combined with the configuration including the patch 40 with two slits 41*b*, 41*c* and two additional conductors 80*b*, 80*c*. In FIG. 28, the slits 41*b*, 41*c* are arranged to be deviated to each other. The slits 41*b*, 41*c* do not sandwich the short-circuit portion 60 in the Y direction. The patch 40 having the slits 41*b* and 41*c* has two-fold symmetry around the Z axis.

Figure 29:
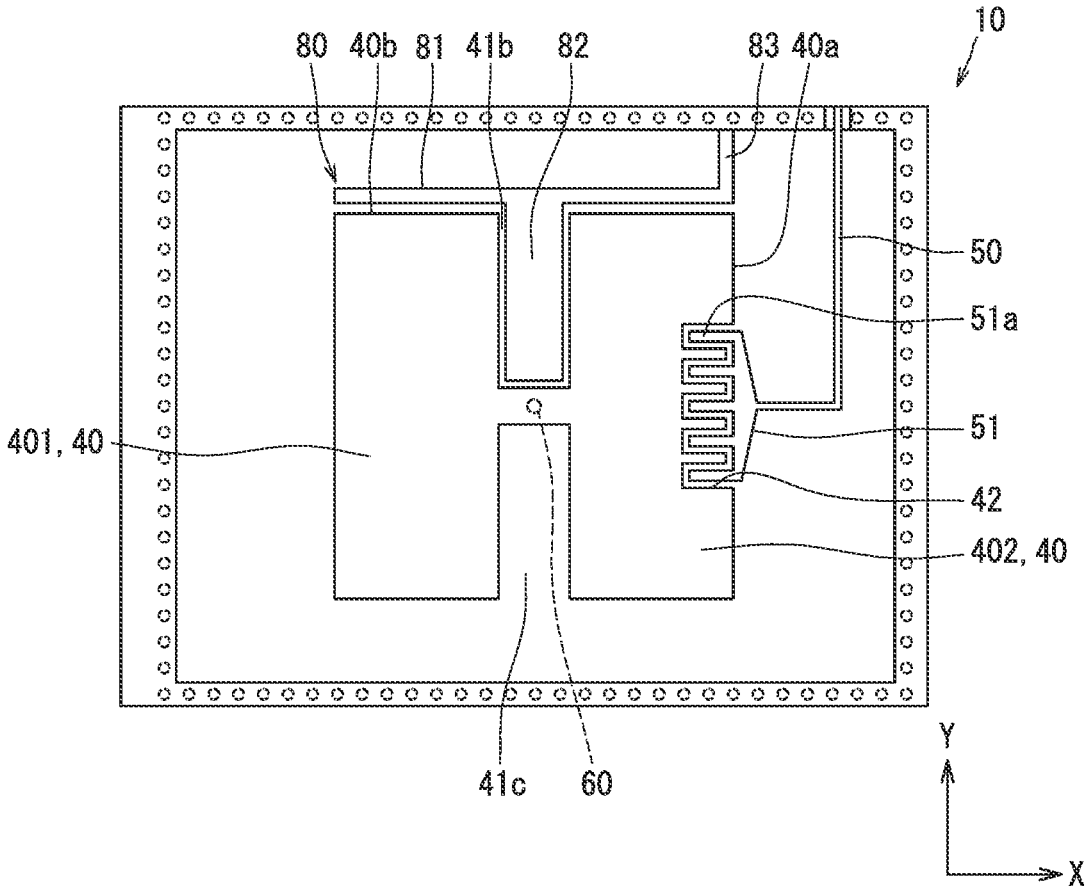
FIG. 29 is a plan view illustrating a modified example.

The present disclosure describes the example in which the branch portion 51 has three protrusions 51*b*. However, the present disclosure is not limited to this example. For example, as shown in the modified example of FIG. 29, the branch portion 51 may have five protrusions 51*b*. As the number of protrusions increases, the parameters are further increased.

The present disclosure describes the example in which the power feeder 50 includes the branch portion 51. However, the present disclosure is not limited to this example. At least one capacitor may be formed between the power feeder 50 and the patch 40. For example, the end portion of the part of the power feeder 50 extending in the X direction may be arranged to face the outer surface 400*a* of the power feeding side 40*a* of the patch 40 to form the capacitor. A portion of the power feeder 50 may be arranged at the notch 42 to form multiple capacitors.

Other Embodiments

The disclosure in this specification and drawings etc. is not limited to the above-described embodiments. The disclosure encompasses the above-described embodiments and modifications based on the embodiments by those skilled in the art. For example, the disclosure is not limited to the combinations of parts and/or elements shown in the embodiments. The present disclosure may be implemented in various combinations. The disclosure may have additional parts that may be added to the embodiments. The disclosure covers omissions of parts and/or elements of the embodiments. The disclosure covers replacement or combination of components, elements between one of the embodiments and another. The disclosed technical scope is not limited to the description of the embodiments.

What is claimed is:

1. An antenna device comprising:

a main board made of a dielectric material;

a ground board disposed at the main board and configured to supply a ground potential;

a patch disposed at the main board to face the ground board in a thickness direction of the main board;

a power feeder disposed at the main board and electrically connected to the patch;

a short-circuit portion including a via conductor disposed at the main board, and electrically connected to the patch and the ground board; and an additional conductor disposed at the main board such that a side surface of the additional conductor faces a side surface of the patch, and having a potential identical to the ground potential of the ground board, wherein the patch includes:

an outer surface configured to define an outer contour of the patch, the outer surface being the side surface of the patch;

at least one slit having an aperture opening to a position that is apart from a part of the outer surface electrically connected with the power feeder; and an inner surface configured to define the slit, the inner surface being the side surface of the patch, and wherein the additional conductor includes:

a base portion that extends in an extending direction along the outer surface of the patch, and that is disposed to face the outer surface around the aperture of the slit;

an inserting portion that is connected to the base portion, and that is disposed inside the slit to face the inner surface of the patch; and a connecting portion that extends from the base portion, and that electrically connects the ground board and the additional conductor.

2. The antenna device according to claim 1, wherein the patch has a rectangular shape in a planar view along the thickness direction, wherein the patch further includes:

a power feeding side electrically connected with the power feeder;

an adjacent side as a side of the patch adjacent to the power feeding side;

an opposite side disposed at a side opposite to the power feeding side, wherein the slit has at least an adjacent slit opening to the outer surface at the adjacent side, and wherein the additional conductor is disposed in at least the adjacent slit.

3. The antenna device according to claim 2, wherein the adjacent side includes a plurality of adjacent sides having a first adjacent side and a second adjacent side, wherein the adjacent slit includes a plurality of adjacent slits, wherein the adjacent slits includes:

a first adjacent slit opening to the outer surface at the first adjacent side; and a second adjacent slit opening to the outer surface at the second adjacent side, and wherein the additional conductor is disposed at one of the first adjacent slit and the second adjacent slit.

4. The antenna device according to claim 1, wherein the base portion is disposed across the aperture of the slit in which the inserting portion connected to the base portion is disposed, and the base portion is disposed to face the outer surface.

5. The antenna device according to claim 1, wherein at least a part of the connecting portion extending from the base portion is disposed at a surface of the main board at which the base portion is disposed.

6. The antenna device according to claim 5, wherein the connecting portion is connected to a position closer to the short-circuit portion than to an end portion of the base portion in the extending direction.

7. The antenna device according to claim 5, wherein the connecting portion is connected to an end portion of the base portion in the extending direction.

8. The antenna device according to claim 1, wherein a capacitor between the power feeder and the patch has a smaller capacitance value than a capacitor between the base portion and the patch.

9. The antenna device according to claim 8, wherein the power feeder has a branch portion that is branched into a plurality of branches, at an end portion of the power feeder near the patch, and wherein the patch has a notch opening to the outer surface for accommodating the branch portion.

* * * * *